US006483250B1

(12) United States Patent
Hashimoto et al.

(10) Patent No.: US 6,483,250 B1
(45) Date of Patent: Nov. 19, 2002

(54) METHOD OF DRIVING PLASMA DISPLAY PANEL, PLASMA DISPLAY DEVICE AND DRIVING DEVICE FOR PLASMA DISPLAY PANEL

(75) Inventors: Takashi Hashimoto; Takahiro Urakabe; Akihiko Iwata; Yoshikazu Tsunoda; Takayoshi Nagai, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/715,124

(22) Filed: Nov. 20, 2000

(30) Foreign Application Priority Data

Feb. 28, 2000 (JP) ..... 2000-051601

(51) Int. Cl.[7] ..... G09G 3/10

(52) U.S. Cl. ..... 315/169.4; 345/41; 345/42; 345/60

(58) Field of Search ..... 315/169.4, 169.1, 315/169.3; 345/41, 42, 55, 60, 76, 78, 208, 211

(56) References Cited

U.S. PATENT DOCUMENTS

| | | | | |
|---|---|---|---|---|
| 4,866,349 A | | 9/1989 | Weber et al. | 315/169.4 |
| 6,002,381 A | * | 12/1999 | Tomio et al. | 345/60 |
| 6,008,687 A | * | 12/1999 | Orita et al. | 327/515 |
| 6,011,355 A | * | 1/2000 | Nagai | 315/169.3 |
| RE37,083 E | * | 3/2001 | Kanazawa | 315/169.4 |

FOREIGN PATENT DOCUMENTS

| | | |
|---|---|---|
| JP | 62-192798 | 8/1987 |
| JP | 63-101897 | 5/1988 |
| JP | 6-314078 | 11/1994 |
| JP | 7-140922 | 6/1995 |
| JP | 7-287548 | 10/1995 |
| JP | 2674304 | 7/1997 |

* cited by examiner

*Primary Examiner*—Don Wong
*Assistant Examiner*—Thuy Vinh Tran
(74) *Attorney, Agent, or Firm*—Oblon, Spivak, McClelland, Maier & Neustadt, P.C.

(57) ABSTRACT

A synthetic round pulse generation circuit can output constant currents (i1, i2). By charging a capacitance element (CP) with the constant currents (i1, i2), a ramp pulse (10*a*) having a rate of voltage change of i1/CP and a ramp pulse (10*b*) having a rate of voltage change of i2/CP are applied to the capacitance element (CP). A synthetic round pulse (11) consists of the ramp pulse (10*a*) and the ramp pulse (10*b*). In the synthetic round pulse (11), the lengths of application time periods (T10*a*, T10*b*) are set so that a discharge is started with the ramp pulse (10*a*). Further, the rate of voltage change (i1/CP) of the ramp pulse (10*a*) is set to a small value so that the intensity of the discharge at a discharge starting time (t11*f*) in the application time period (T10*a*) may be sufficiently weak. When a PDP is driven with the synthetic round pulse, it is thereby possible to reduce an application time of the round waveform.

7 Claims, 14 Drawing Sheets

METHOD OF DRIVING PLASMA DISPLAY PANEL, PLASMA DISPLAY DEVICE AND DRIVING DEVICE FOR PLASMA DISPLAY PANEL

BACKGROUND OF THE INVENTION

1. Field of the Invention

The present invention relates to a method of driving a plasma display panel (hereinafter, also referred to as "PDP"), and more particularly to a technique in using a round waveform for driving the PDP to reduce an application time of the round waveform.

2. Description of the Background Art

Various studies have been made on a PDP as a thin-type television and a display monitor. Among the PDPs, there is a surface discharge AC-type PDP as one of AC-type PDPs having a memory function.

(Structure of PDP)

FIG. 17 is a perspective view showing an AC-type PDP 101 in the background art. The PDP of this structure is disclosed in Japanese Patent Application Laid Open Gazette Nos. 7-140922 and 7-287548.

The PDP 101 comprises a front glass substrate 102 as a display surface and a rear glass substrate 103 opposed to the front glass substrate 102 with a discharge space 111 sandwiched therebetween.

On a surface of the front glass substrate 102 on the side of the discharge space 111, n strip-like electrodes 104*a* and n strip-like electrodes 105*a* which are paired respectively are extendedly formed. For convenience of illustration range, one electrode 104*a* and one electrode 105*a* are shown in FIG. 17. The electrodes 104*a* and 105*a* which are paired with each other are arranged with a discharge gap DG interposed therebetween. The electrodes 104*a* and 105*a* work to induce a discharge. Further, a transparent electrode is used for the electrodes 104*a* and 105*a* to extract more visible light, and hereinafter the electrodes 104*a* and 105*a* are also referred to as transparent electrodes 104*a* and 105*a*. Furthermore, in some cases, the electrodes 104*a* and 105*a* are made of the same material as metal (auxiliary) electrodes (or bus electrodes) 104*b* and 105*b* as discussed later are made of On the transparent electrodes 104*a* and 105*a*, the metal (auxiliary) electrodes (or bus electrodes) 104*b* and 105*b* are formed extendedly along the transparent electrodes 104*a* and 105*a*. The metal electrodes 104*b* and 105*b* have impedance lower than those of the transparent electrodes 104*a* and 105*a*, and work to supply a current from a driving device.

In the following discussion, an electrode constituted of the transparent electrode 104*a* and the metal electrode 104*b* is referred to as a (row) electrode 104 (or X) and an electrode constituted of the transparent electrode 105*a* and the metal electrode 105*b* is referred to as a (row) electrode 105 (or Y). The row electrodes 104 and 105 (or row electrodes X and Y) which are paired with each other are also referred to as a pair of (row) electrodes 104 and 105 (or a pair of (row) electrodes X and Y). Further, in some cases, the row electrode 104 is constituted of only electrode which corresponds to the electrode 104*a* and/or the row electrode 105 is constituted of only electrode which corresponds to the electrode 105*a*.

A dielectric layer 106 is formed covering the row electrodes 104 and 105 and a protection film 107 made of MgO (magnesium oxide) which is a dielectric substance is formed on a surface of the dielectric layer 106 by evaporation method and the like. The dielectric layer 106 and the protection film 107 are also generally referred to as a dielectric layer 106A. Further, in some cases, the dielectric layer 106A does not include the protection film 107.

On the other hand, on a surface of the rear glass substrate 103 on the side of the discharge space 111, m strip-like (column) electrodes 108 are so formed extendedly as to be orthogonal to (as to grade-separately intersect) the row electrodes 104 and 105. Hereinafter, the (column) electrode 108 is also referred to as a (column) electrode W Furthermore, for convenience of illustration range, three electrodes 108 are shown in FIG. 17.

Between the adjacent column electrodes 108, a barrier rib 110 is formed extendedly in parallel with the column electrodes 108. The barrier ribs 110 separate a plurality of discharge cells (discussed later) arranged along the extending direction of the row electrodes 104 and 105 from each other and the barrier ribs 110 support the PDP 101 so as not to be crushed by atmospheric pressure.

Inside a substantial U-shaped trench constituted of the adjacent barrier ribs 110 and the rear glass substrate 103, a phosphor layer 109 is formed covering the column electrode 108. In more detail, in the above substantial U-shaped trenches, phosphor layers 109R, 109G and 109B for respective emitted light colors, red, green and blue are formed and for example, the phosphor layers 109R, 109G and 109B are arranged in this order in the entire PDP 101.

The front glass substrate 102 and the rear glass substrate 103 having the above structure are sealed with each other and the discharge space 111 between the front glass substrate 102 and the rear glass substrate 103 is filled with discharge gas such as Ne—Xe mixed gas or the He—Xe mixed gas under a pressure lower than the atmospheric pressure.

In the PDP 101, a discharge cell or a light emitting cell is formed at a (grade-separation) intersection of the row electrodes 104 and 105 and the column electrode 108. Specifically, three discharge cells are shown in FIG. 17.

(Principle of Operation of PDP)

Next, a principle of display operation of the PDP 101 will be discussed. First, a voltage or a voltage pulse is applied across the row electrodes 104 and 105 to generate a discharge in the discharge space 111. Then, by exciting the phosphor layer 109 with an ultraviolet ray generated by this discharge, the discharge cell emits light or lights up. Charged particles such as electrons and ions generated in the discharge space 111 through this discharge move in a direction of the row electrode to which a voltage having a polarity reverse to that of the charged particles is applied and are accumulated on the surface of the dielectric layer 106A on the row electrode (referred to as "on the row electrode" hereinafter). The electric charges such as electrons and ions accumulated on the surface of the dielectric layer 106A are referred to as "wall charges."

Since the respective wall charges accumulated on the row electrodes 104 and 105 through the discharge form an electric field in a direction of weakening the electric field between the pair of the row electrodes 104 and 105, the discharge quickly disappears with formation and accumulation of the wall charges. When a voltage having polarity reverse to that of the above voltage is applied to the row electrodes 104 and 105 after the discharge disappears, an electric field in which the electric field generated by the applied voltage is superimposed on the electric field generated by the wall charges is substantially applied to the discharge space 111, i.e., a voltage in which the applied voltage is superimposed on the voltage (wall voltage) generated by the wall charges is substantially applied to the discharge space 111. The superimposed electric field can cause a discharge again.

Specifically, once the discharge is generated, continuous discharge (sustain discharge) can be caused by a voltage (sustain voltage) lower than the applied voltage used for starting the initial discharge through the electric field generated by the wall charges. Therefore, after the discharge is once generated, by alternately applying a pulse (sustain pulse) having an amplitude of sustain voltage to the row electrodes 104 and 105, in other words, by applying the sustain pulse across the row electrodes 104 and 105 with its polarity reversed, the discharge can be regularly sustained and continued (sustain operation).

Specifically, the discharge can be continued by continuously applying the sustain pulse until the wall charges disappear. Further, to extinguish the wall charges is referred to as "an erase operation" (or simply as "an erase") while to form the wall charges on the dielectric layer 106A at the start of continuous discharge (sustain discharge) is referred to as "a writing operation" (or simply as "a writing").

An actual image display is repeated with one field set within 16.6 ms, considering the human visual characteristics. At this time, in general, one field is divided into a plurality of subfields and the subfields have different luminances to make a gradation or tone. One subfield includes a reset period, an addressing period and a sustain period.

In the reset period, discharge (priming discharge) is generated in all the cells regardless of display history in order to enhance the discharge probability. Concurrently with this discharge, the wall charges are erased to erase the display history.

In the addressing period, a discharge cell is selected in matrix by combination of the row electrode 104 (105) and the column electrode 108 to generate a discharge (writing discharge or addressing discharge) in the predetermined discharge cell(s).

In the sustain period, discharges are repeatedly generated a predetermined number of times in the discharge cell(s) in which the writing discharge is generated in the addressing period. The luminance depends on the number of repeating generations of discharges.

In a predetermined discharge cell (or a plurality of predetermined discharge cells) among a plurality of discharge cells arranged in matrix, the writing discharge is first generated and then the sustain discharge is generated, to display characters, figures, images and the like. Further, by quickly performing the writing operation, the sustain operation and the erase operation, a movie display can be also performed.

(Power Recovery Circuit)

The PDP 101, which has the above structure, forms a capacitive load having floating capacitance among the row electrodes 104 and 105 and the column electrode 108. Therefore, a current flows in a capacitance element of the PDP 101 every time when the voltage is applied. The power of this time is not concerned in the display and therefore referred to as a reactive power. Next, a power recovery circuit (hereinafter, referred to simply as a recovery circuit) for recovering and recycling such a reactive power will be discussed. In the sustain period, generally, the sustain pulse of about 40 kHz is applied to the PDP. Since the reactive power largely depends on the frequency of the sustain pulses, the recovery circuit is used to recover the reactive power generated in the operation during the sustain period.

FIG. 18 is a circuit diagram showing a recovery circuit in the background art. This is disclosed in e.g., Japanese Patent Application Laid Open Gazette Nos. 63-101897 and 62-192798. In FIG. 18, the PDP 101 is schematically represented as capacitance element CP. Herein, discussion will be made on a case where a voltage pulse is applied to an electrode (which corresponds to the electrode X) on the left side of the capacitance element CP as one faces the figure.

The rise of the voltage pulse is performed as follows. First, a switch 312 of a recovery circuit 302 is turned on to move the electric charges accumulated in a capacitor 310 to the capacitance element CP through a reactor 308. This carries a current. After that, at a proper timing, a switch 304 is turned on to apply a voltage (sustain pulse) Vs of a main power supply to the electrode on the left side of the capacitance element CP.

On the other hand, the fall of the voltage pulse is performed as follows. First, the switches 304 and 312 are turned off and a switch 313 is turned on. The electric charges are thereby moved from the capacitance element CP to the recovery capacitor 310 through the reactor 308 and the switch 313 and the electric charges are accumulated in the recovery capacitor 310. After that, a switch 305 is turned on to bring the electrode on the left side of the capacitance element CP into a ground potential (GND), and the voltage pulse thereby falls.

This operation, only to move the electric charges between the capacitance element CP and the recovery capacitor 310, loses the reactive power. Further, moving the electric charges between an electrode (which corresponds to the electrode Y) on the right side of the capacitance element CP and the recovery capacitor 311 can be performed in the same manner.

(Driving Method Using Round Pulse)

In general, as a sustain pulse used is a rectangular waveform or a rectangular pulse having a sharp rise, in other words, a rectangular pulse which rises fast. The rectangular pulse is used in order to generate an intense discharge by the sustain pulse and thereby generate a sufficient amount of wall charges. In more detail, in a case of using the rectangular pulse which rises sufficiently fast, the discharge starts after the rectangular pulse reaches a final attainment potential (or final attainment voltage; hereinafter, also referred to simply as a final potential (or final voltage)). Specifically, from the time when the applied voltage exceeds a firing voltage until the discharge is actually generated, there is a time lag called a discharge delay time. The applied rectangular pulse reaches the final potential before the discharge delay time passes. Therefore, since a sufficient high voltage is applied to the discharge space, a lot of wall charges are generated and accumulated.

In contrast to this, as the priming discharge and the like, a pulse of round waveform, i.e., a round pulse is used, in some cases. Since it is desirable that a discharge not for display luminescence, such as the priming discharge, is weak in terms of contrast, the round pulse which can generate a relatively weak discharge is used. Further, also when the wall charges are erased, a predetermined amount of wall charges are generated or the like, the round pulse is sometimes used.

When the rise time (and/or fall time) of the round pulse is longer than the discharge delay time and the round pulse rises (falls) sufficiently slow, a very weak discharge starts at the minimum voltage value. In the case of this discharge, the amount of movement of wall charges is very small and the discharge continues all the while the voltage continues to change after the discharge starts. In more detail, the discharge is once generated near the firing voltage to generate a very small amount of wall charges. Since the voltage across electrodes exceeds the firing voltage again with the continuous rise of the applied voltage, the discharge is generated again. By repeating generations of such a very small discharge, a weak discharge continues all the while the applied voltage continues to change. At this time, a predetermined amount of wall charges which depend on the final potential of the round pulse are stably generated. Furthermore, it is possible to extinguish the wall charges, depending on the application polarity and the final potential of the round pulse.

The round pulse mainly includes two types of pulses, i.e., a "CR waveform (or CR pulse)" and a "ramp waveform (or ramp pulse)" (see a CR pulse 20 and a ramp pulse 10 of FIG. 19). These waveforms will be discussed below.

The CR pulse is obtained when a capacitance element is charged (or discharged) through a resistance element. When a capacitance element C having a voltage of 0 in an initial state is charged by a power supply having a voltage V0 (>0) through a resistance element R, a voltage of the capacitance element C, i.e., a voltage v(t) of the CR pulse is expressed as $$v(t)=V0\times(1-\exp(-t/\tau))$$

where t represents time and τ is a time constant expressed by a product of the capacitance element C and the resistance element R (τ=C×R). Since the voltage v(t) includes a term of exponential function, the waveform of the voltage v(t) is sometimes termed "an exponential waveform".

The rate of change dv(t)/dt (hereinafter, also referred to as "dv/dt") of the voltage v(t) with respect to time t is obtained as $$dv(t)/dt=(V0/\tau)\times\exp(-t/\tau)$$

It can be seen from this equation that the rate of voltage change dv(t)/dt of the CR pulse is large immediately after the application and gradually becomes smaller with time. Since the PDP is a capacitive load, as discussed earlier, the CR pulse can be applied to the electrode of the PDP or the capacitance element only by supplying the voltage to the electrode through a resistance.

On the other hand, the voltage v(t) of the ramp pulse is in proportion to an application time t, and in other words, it increases (or decreases) at a constant rate of voltage change dv/dt. With the ramp pulse, unlike with the CR pulse, the discharge can be started always at a constant rate of voltage change, not depending on variation in firing voltage. Therefore, it is possible to absorb variation in discharge characteristics of the discharge cells and suppress variation in light emission all over the PDP.

The CR pulse and the ramp pulse, however, have the following problems.

(Problem of CR Pulse)

When a discharge is started with a relatively low voltage by using the CR pulse, there is a problem of a long application time of the pulse.

As discussed above, the rate of voltage change dv/dt is large immediately after the CR pulse is applied, and in such a time region where the rate of voltage change is large, an intense discharge is generated, like with the rectangular pulse. Further, even with the ramp pulse, if the rate of voltage change dv/dt is large, such an intense discharge is generated.

This is because when the rate of voltage change dv/dt is large, the voltage v(t) of the round pulse (including the CR pulse and the ramp pulse) reaches a high voltage after it exceeds the firing voltage before the discharge delay time passes, like in the case of the rectangular pulse. When the intense discharge is generated, a lot of wall charges are generated and accumulated. Since the wall charges have a polarity to suppress (weaken) the externally-applied voltage, once a lot of wall charges are accumulated, the voltage does not exceed the firing voltage again even with the continuous increase of the voltage of the round pulse. As a result, the discharge is intermitted and the characteristic feature of the round pulse can not be obtained. Specifically, the above-discussed continuous weak discharge can not be obtained and it is therefore impossible to stably obtain a predetermined amount of wall charges which depend on the final potential of the round pulse.

In order to obtain the characteristic feature of the round pulse, it is necessary to sufficiently lower the rate of voltage change dv/dt at the start of discharge, and specifically, it is necessary to sufficiently increase the time constant τ in the case of the CR pulse. When the rate of voltage change dv/dt is lowered, however, the time period until the round pulse completely rises, i.e., the application time of the pulse becomes longer. In the case of the CR pulse, particularly, since the rate of voltage change dv/dt becomes smaller as the time passes from the application of the pulse, it takes very long for the voltage to approximate the final voltage.

Additionally, when there is variation in firing voltage of the discharge cells, when the discharge is started in all the discharge cells with a small rate of voltage change dv/dt, there arises a necessity to further increase the time constant. In contrast to this, with the ramp pulse, as discussed above, it is possible to start the discharge always at a constant rate of voltage change, not depending on the variation in firing voltage.

(Problem of Ramp Pulse)

When the discharge is started with a high applied voltage because of a small amount of wall charges, the polarity of the wall charges reverse to that of the round waveform or the like, however, it sometimes becomes necessary to apply the ramp pulse for a long time. This will be discussed with reference to FIG. 19.

In FIG. 19, the ramp pulse 10 and the CR pulse 20 are staggered so that the respective rate of voltage changes dv/dt of the ramp pulse 10 and the CR pulse 20 at the firing voltage Vf may be equal to each other. In other words, the tangent of the CR pulse 20 at the firing voltage Vf corresponds to the ramp pulse 10. Further, it is assumed that the rate of voltage change dv/dt or the inclination of waveform of the ramp pulse 10 keeps to such a minimum as to generate a very weak discharge in the discharge cell having the firing voltage Vf.

At this time, as can be seen from FIG. 19, a time period T10*gf* from the time when the ramp pulse 10 rises to the time when it reaches the firing voltage Vf is longer than a time period T20*gf* from the time when the CR pulse 20 rises to the time when it reaches the firing voltage Vf. Further, a time period T10*fr* from the time when the ramp pulse 10 is at the firing voltage Vf to the time when it reaches the final voltage Vr is shorter than a time period T20*fr* from the time when the CR pulse 20 is at the firing voltage Vf to the time when it reaches the final voltage Vr. Furthermore, the relation between the sum of the time periods T10*gf* and T10*fr* and the sum of the time periods T20*gf* and T20*fr* depends on the relation between the firing voltage Vf and the rate of voltage change dv/dt needed at the start of discharge.

Thus, with the round pulse which has the rate of voltage change dv/dt giving the above characteristic feature, a very long application time is needed.

(Problem in Method of Driving Using Round Pulse)

An driving operation in one driving cycle of the PDP has to be completed within one field period (about 16 ms in the case of NTSC-TV signal) of an image input signal. If the driving operation is not completed within one field period, there arise problems of not-synchronization between a signal input and a display image and the like.

Since the application time of the round pulse is very long as discussed above, there may occur a case where the driving operation can not be completed within one field period in a driving method using the round pulse. Therefore, in a case of using the round pulse, it is necessary to, for example, reduce the number of subfields or narrow the width of a pulse other than the round pulse such as the applied pulse in the addressing period (address pulse) and the sustain pulse.

Reducing the number of subfields, however, causes deterioration of display quality such as decrease in the number of tones. Further, narrowing the width of the address pulse, the sustain pulse and the like makes the discharge unstable and as a result, a driving voltage margin decreases to make the operation unstable. Therefore, when the round pulse is used, it is desirable to reduce the needed time.

One of techniques to reduce the application time of the round pulse is disclosed in Japanese Patent Application Laid Open Gazette No. 6-314078. This technique will be discussed with reference to FIGS. 20 and 21. As shown in FIG. 20, in a round pulse generation circuit 401 disclosed in the laid open gazette, a Zener diode 403 is connected in parallel to a resistor 402. In the round pulse generation circuit 401, it is possible to apply a voltage which sharply changes at an initial time of pulse application and then gently changes (at low rate of voltage change), such as a voltage pulse 410 shown in FIG. 21.

For example, if the discharge starts in a region where the voltage changes sharply when there is very large variation in firing voltage or the firing voltage is lowered with time-varying change, however, the above-discussed intense discharge is generated even with the pulse 410 and the characteristic feature of the round pulse can not be obtained.

Further, the round pulse generation circuit 401 has problems of large circuit scale and high cost. This will be discussed below. When the voltage sharply changes, a very large current flows in the Zener diode 403 and a voltage over a Zener voltage Vz is applied thereto. Therefore, there occurs a very large power loss in the Zener diode 403. Further, since the Zener voltage Vz itself is a voltage equivalent to the firing voltage, it is necessary to use a diode of high breakdown voltage as the Zener diode 403. Thus, since the Zener diode 403 needs a high breakdown and a large permissible loss, the round pulse generation circuit 401 is large in circuit scale and needs high cost.

SUMMARY OF THE INVENTION (1) The present invention is directed to a method of driving a plasma display panel which comprises a discharge cell including a first electrode and a second electrode, capable of controlling generation/non-generation of discharge with potential difference between the first electrode and the second electrode. According to a first aspect of the present invention, the method of driving a plasma display panel comprises: a pulse applying step of applying a voltage pulse which continuously changes from a first voltage to a second voltage to the first electrode, and in the method of the first aspect, the pulse applying step comprises the steps of: (a) generating a first region of the voltage pulse by a first pulse generation system and applying the same; and (b) generating a second region of the voltage pulse different from the first region by a second pulse generation system different from the first pulse generation system and applying the same.

(2) According to a second aspect of the present invention, in the method of the first aspect, a voltage change in the first region is gentler than that in the second region.

(3) According to a third aspect of the present invention, in the method of the second aspect, the step (a) is performed after the step (b).

(4) According to a fourth aspect of the present invention, in the method of any one of the first to third aspects, the pulse applying step further comprises the step of: (c) generating a third region of the voltage pulse different from the first and second regions by a third pulse generation system different from the first pulse generation system and applying the same.

(5) According to a fifth aspect of the present invention, in the method of any one of the first to fourth aspects, the voltage pulse includes part of one of a CR voltage pulse, a ramp voltage pulse and an LC resonant voltage pulse.

(6) According to a sixth aspect of the present invention, in the method of any one of the first to fifth aspects, the voltage pulse is generated by utilizing a reactive power generated in driving the plasma display panel in the pulse applying step.

(7) According to a seventh aspect of the present invention, in the method of driving a plasma display panel which comprises a discharge cell including a first electrode and a second electrode, capable of controlling generation/non-generation of discharge with potential difference between the first electrode and the second electrode, a voltage pulse which continuously changes from a first voltage to a second voltage and changes more sharply as it approaches the second voltage is applied to the first electrode.

(8) The present invention is also directed to a plasma. display device. According to an eighth aspect of the present invention, the plasma display device comprises a plasma display panel comprising a discharge cell including a first electrode and a second electrode; and a driving unit for driving the discharge cell by giving a potential difference between the first electrode and the second electrode, and in the plasma display device of the eighth aspect, the driving unit comprises a pulse generation unit capable of generating a voltage pulse by using a first pulse generation system and a second pulse generation system, and the driving unit generates the voltage pulse including a first region generated by the first pulse generation system and a second region being different from the first region, generated by the second pulse generation system and continuously changing from a first voltage to a second voltage, to output the voltage pulse as a voltage to be applied to the first electrode.

(9) According to a ninth aspect of the present invention, in the plasma display device of the eighth aspect, a voltage change in the first region is gentler than that in the second region.

(10) According to a tenth aspect of the present invention, in the plasma display device of the ninth aspect, the driving unit generates the first region before the second region.

(11) According to an eleventh aspect of the present invention, in the plasma display device of any one of the eighth to tenth aspects, the pulse generation unit generates the voltage pulse by further using a third pulse generation system different from the first pulse generation system, and the driving unit generates the first region between the second region and a third region different from the first and second regions, the third region is generated by the third pulse generation system.

(12) According to a twelfth aspect of the present invention, in the plasma display device of any one of the eighth to eleventh aspects, the voltage pulse includes part of one of a CR voltage pulse, a ramp voltage pulse and an LC resonant voltage pulse.

(13) According to a thirteenth aspect of the present invention, in the plasma display device of any one of the eighth to twelfth aspects, the driving unit further comprises a power recovery unit, and the driving unit generates the voltage pulse by utilizing a reactive power recovered in the power recovery unit.

(14) According to a fourteenth aspect of the present invention, the plasma display device comprises a plasma display panel comprising a discharge cell including a first electrode and a second electrode; and a driving unit for driving the discharge cell by giving a potential difference between the first electrode and the second electrode, and in the plasma display device of the fourteenth aspect, the driving unit generates a voltage pulse which continuously changes from a first voltage to a second voltage and changes more sharply as it approaches the second voltage, to output the voltage pulse as a voltage to be applied to the first electrode.

(15) The present invention is further directed to a driving device for a plasma display panel, the plasma display panel comprising a discharge cell including a first electrode and a second electrode. According to a fifteenth aspect of the present invention, the driving device for a plasma display panel comprises the driving unit as defined in any one of the eighth to fourteenth aspects.

(1) By the method of the first aspect of the present invention, the first region and the second region of the voltage pulse can be controlled and set independently of each other. Therefore, it is possible to reduce the application time of the voltage pulse as compared with the case of generating and applying the voltage pulse only by a single pulse generation system.

(2) By the method of the second aspect of the present invention, the voltage change in the first region is gentler than that of the second region. In other words, the voltage change in the second region is sharper than that in the first region. Therefore, it is possible to reduce the application time of the voltage pulse as compared with the case of generating and applying the voltage pulse only by the first pulse generation system. This effect can be obtained regardless of whether the first region or the second region is precedent to the other.

In this case, when a discharge is generated in the first region, the discharge is weaker than that generated in the second region. Further, with a sufficiently gentle voltage change in the first region, a continuous very weak discharge can be generated, and as a result, an effect caused by such a continuous very weak discharge, e.g., of stably generating a constant amount of wall charges which depend on the voltage at the end of application of the voltage pulse can be produced.

(3) By the method of the third aspect of the present invention, the second region in which the voltage pulse is sharper than that in the first region is provided before the first region. In this case, by making the voltage pulse in the second region gentler, even if the discharge is started in the second region, the above continuous very weak discharge can be generated in the subsequent first region.

(4) By the method of the fourth aspect of the present invention, with the voltage pulse in the third region sharper than that in the first region, it is possible to reduce the application time as compared with the method of the first aspect.

(5) The method of the fifth aspect of the present invention can produce the same effect as any one of the methods of the first to fourth aspects produces.

(6) The method of the sixth aspect of the present invention can produce the same effect as any one of the methods of the first to fifth aspects produces and allows reduction in reactive power which is not concerned in the display.

(7) By the method of the seventh aspect of the present invention, it is possible to reduce the application time of the voltage pulse as compared with that of e.g., the ramp voltage pulse.

In this case, when a discharged is generated in a region near the first voltage where the voltage change is gentle, a discharge weaker than that in a region where the voltage change is sharp can be achieved. Further, with a sufficiently gentle voltage change in the region where the voltage change is gentle, a continuous very weak discharge can be generated, and as a result, an effect caused by such a continuous very weak discharge, e.g., of stably generating a constant amount of wall charges which depend on the voltage at the end of application of the voltage pulse can be produced.

(8) The plasma display device of the eighth aspect of the present invention can produce the same effect as the method of the first aspect produces.

(9) The plasma display device of the ninth aspect of the present invention can produce the same effect as the method of the second aspect produces.

(10) The plasma display device of the tenth aspect of the present invention can produce the same effect as the method of the third aspect produces.

(11) The plasma display device of the eleventh aspect of the present invention can produce the same effect as the method of the fourth aspect produces.

(12) The plasma display device of the twelfth aspect of the present invention can produce the same effect as the method of the fifth aspect produces.

(13) The plasma display device of the thirteenth aspect of the present invention can produce the same effect as the method of the sixth aspect produces.

(14) The plasma display device of the fourteenth aspect of the present invention can produce the same effect as the method of the seventh aspect produces.

(15) By the driving device of the fifteenth aspect of the present invention, it is possible to provide a driving device for a plasma display panel which can produce any one of the effects of the eighth to fourteenth aspects.

A first object of the present invention is to provide a method of driving a plasma display panel, which allows reduction in application time as compared with a case of applying, e.g., the CR pulse.

A second object of the present invention is to provide a method of driving a plasma display panel, which produces an effect of stably generating a constant amount of wall charges which depend on, e.g., the final voltage by the round pulse, as well as achieves the first object.

A third object of the present invention is to provide a method of driving a plasma display panel, which allows reduction in reactive power, as well as achieves the first and second objects.

A fourth object of the present invention is to provide a plasma display device and a driver for a plasma display panel, which can achieve the first to third objects.

These and other objects, features, aspects and advantages of the present invention will become more apparent from the following detailed description of the present invention when taken in conjunction with the accompanying drawings.

DESCRIPTION OF THE PREFERRED EMBODIMENTS

<The First Preferred Embodiment >

(Constitution of Plasma Display Device)

Figure 1:
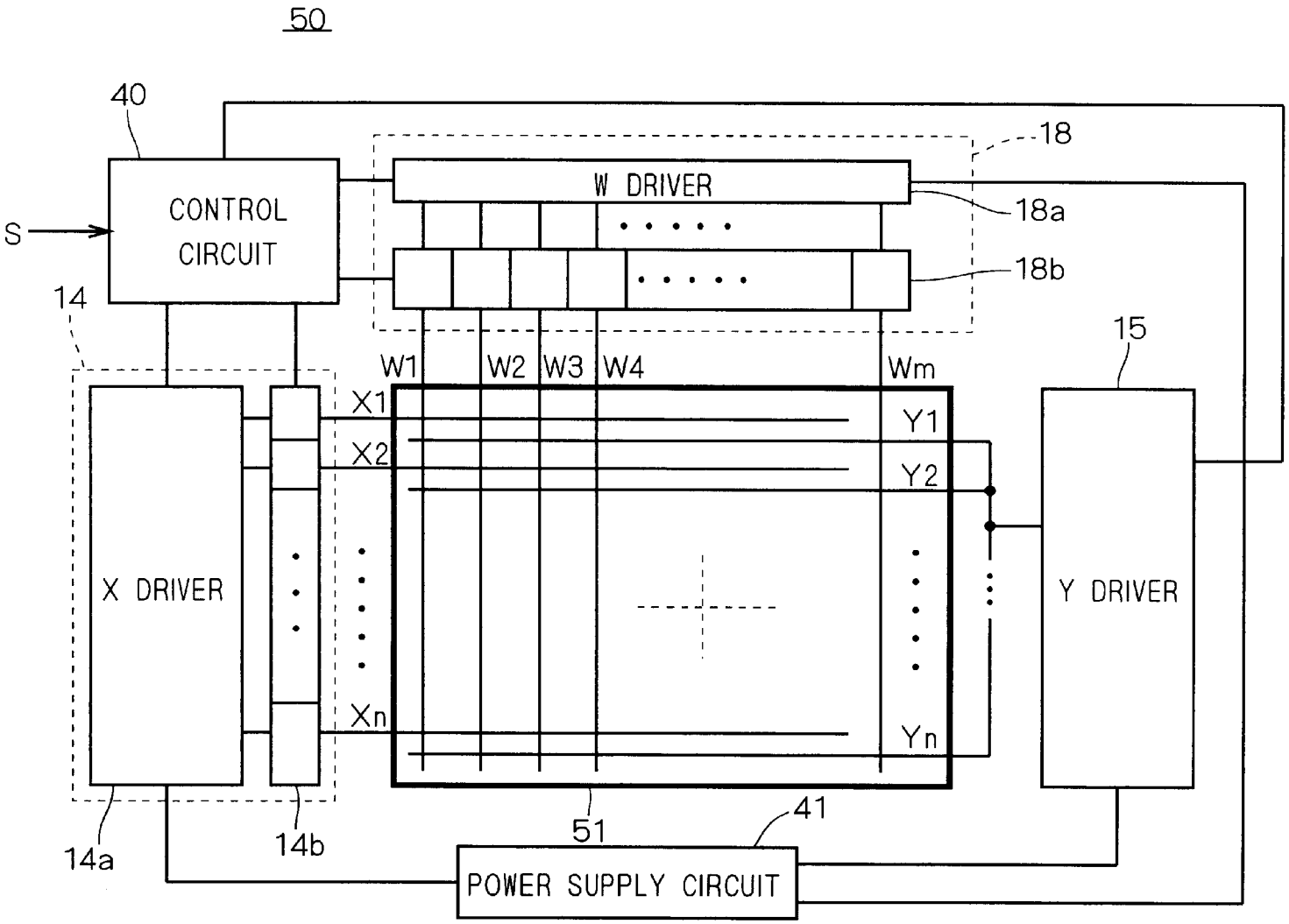
FIG. 1 is a block diagram showing an overall structure of a plasma display device in accordance with a first preferred embodiment of the present invention.

FIG. 1 is a block diagram showing an overall structure of a plasma display device 50 in accordance with the first preferred embodiment. The plasma display device 50 comprises a PDP 51, driving devices 14, 15 and 18, a control circuit 40 and a power supply circuit 41 for supplying various voltages for the driving devices 14, 15 and 18.

The driving device 18 includes a W driver 18*a* and a driving IC 18*b*, and the driving IC 18*b* is driven by the W driver 18*a*. The driving device 14 includes an X driver (driving unit) 14*a* like the W driver 18*a* and a driving IC 14*b*, and the driving IC 14*b* is driven by the X driver 14*a*. The driving device 15 includes a Y driver like the W driver 18*a*. The control circuit 40 controls the driving devices 14, 15 and 18 in response to a video signal. The driving devices 14 and 15 are each constituted of a switch element such as a field effect transistor (FET) and other circuit components and further each include a recovery circuit (discussed later).

As the PDP 51, applicable are various PDPs each comprises discharge cells. Each of the discharge cells includes a first electrode and a second electrode, capable of controlling generation/non-generation of discharge by potential difference between the first electrode and the second electrode. Herein, discussion will be made on a case where the background-art PDP 101 is used as the PDP 51, and the row electrode X corresponds to the first electrode and the row electrode Y corresponds to the second electrode. As discussed earlier, the electrode X and the electrode Y may be each constituted of a transparent electrode and a metal electrode, or may be each made of only a metal electrode. Further, in FIG. 1, only n row electrodes X1 to Xn, n row electrodes Y1 to Yn, m column electrode W1 to Wm among constituent elements of the PDP 51 are schematically shown. Further, in the following discussion, attention will be mainly paid to one discharge cell.

Figure 2:
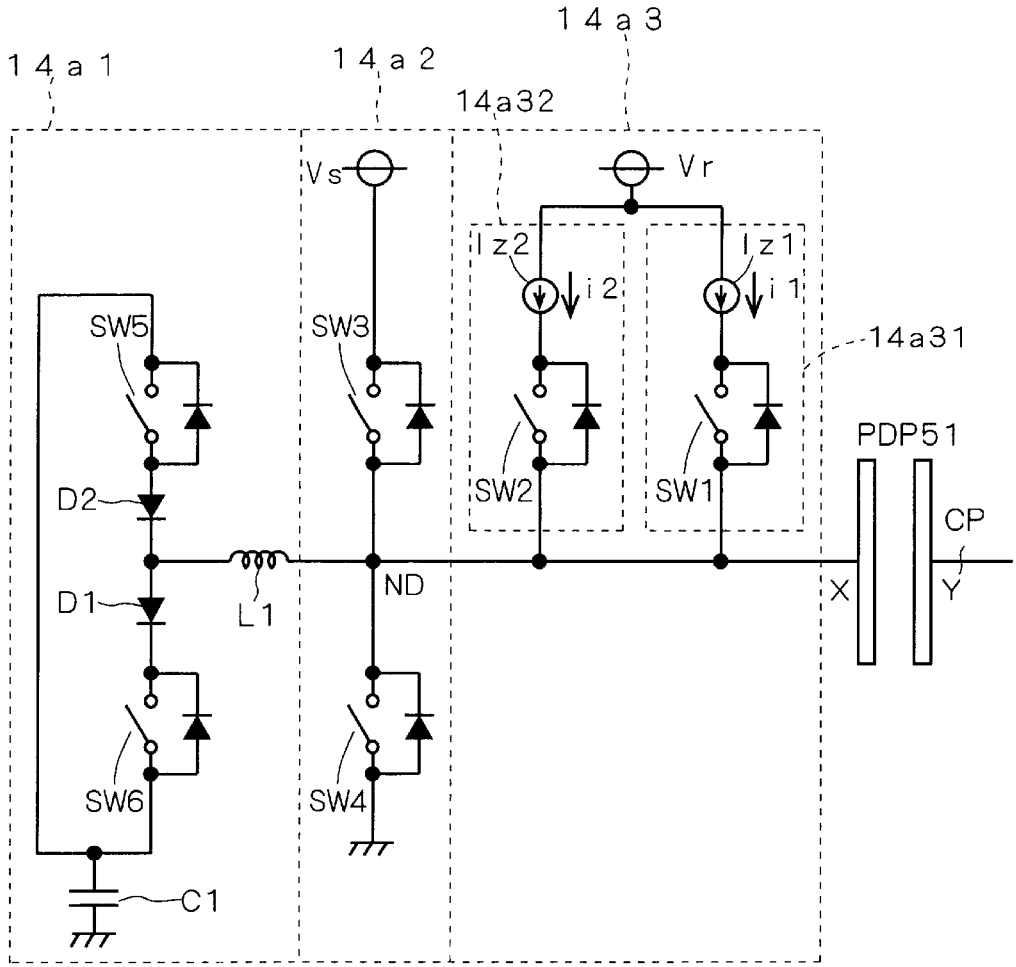
FIGS. 2 and 3 are circuit diagrams each showing a driving device for the plasma display panel in accordance with the first preferred embodiment of the present invention.

FIG. 2 is a circuit diagram showing the X driver 14*a*. Further, in FIG. 2, only constituent elements necessary for the following discussion are shown and the PDP 51 is represented as the capacitance element CP. The X driver 14*a* includes a power recovery circuit (power recovery unit) 14*a*1, a sustain circuit 14*a*2 and a synthetic round (voltage) pulse generation circuit (pulse generation unit) 14*a*3. Further, in the discussion of the first preferred embodiment and the following preferred embodiments, the round (voltage) pulse refers to a voltage pulse which continuously changes from a first voltage to a second voltage, unlike the rectangular (voltage) pulse. In more detail, the round (voltage) pulse refers to a voltage pulse which reaches the final voltage (which corresponds to the second voltage) after a time longer than the discharge delay time passes from the point of time when it exceeds the firing voltage. Specifically, the round (voltage) pulse includes the CR (voltage) pulse, the ramp (voltage) pulse and an LC resonant (voltage) pulse discussed later.

The recovery circuit 14*a*1 comprises a recovery capacitor C1 having one end connected to ground and the other end connected to a cathode of a diode D1 through a switch element SW6. As the switch element SW6 and switch elements SW1 to SW5 discussed later, switch elements such as a field effect transistor (FET), a bipolar transistor and an IGBT (Insulated Gate Bipolar Transistor) are applicable, and the switch element is represented by a switch and a body diode in FIG. 2 and the like. An anode of the diode D1 is connected to one end of a recovery coil L1 and a cathode of a diode D2. An anode of the diode D2 is connected to the other end of the recovery capacitor C1 through the switch element SW5. Further, the other end of the recovery coil L1 is connected to one electrode (which corresponds to the electrode X) of the capacitance element CP.

The sustain circuit 14*b* includes two switch elements SW3 and SW4 connected in series between a power supply for outputting a (sustain) voltage Vs and a ground potential. The switch element SW3 is provided on the side of the power supply and the switch element SW4 is provided on the side of the ground potential. A node ND between the switch elements SW3 and SW4 is connected to the other end of the recovery coil L1.

The synthetic round pulse generation circuit 14*a*3 includes two round pulse generation circuits 14*a*31 and 14*a*32, and the round pulse generation circuits 14*a*31 and 14*a*32 are connected in parallel between a power supply for outputting the (final) voltage Vr and the other end of the recovery coil L1 (or one electrode of the capacitance element CP).

The round pulse generation circuit 14*a*31 includes a series circuit consisting of a constant current element Iz1 provided on the side of the power supply and the switch element SW1 provided on the side of the capacitance element CP. Similarly, the round pulse generation circuit 14*a*32 includes a series circuit consisting of a constant current element Iz2 provided on the side of the power supply and the switch element SW2 provided on the side of the capacitance element CP. The constant current elements Iz1 and Iz2 carry constant currents (values) i1 and i2, respectively, where the current value i2 is larger than the current value i1. The constant current values i1 and i2 are supplied for the capacitance element CP by controlling the switch elements SW1 and SW2, respectively.

Figure 3:
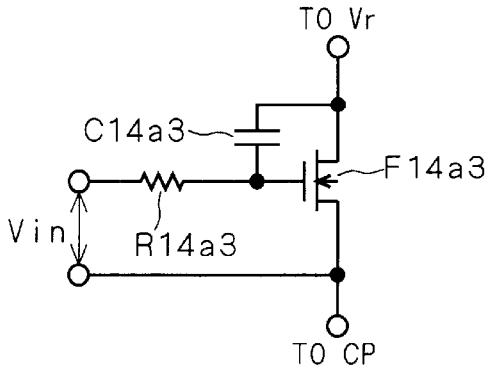

FIG. 3 is a more specific circuit diagram showing each of the round pulse generation circuits 14*a*31 and 14*a*32. As shown in FIG. 3, each of the round pulse generation circuits 14*a*31 and 14*a*32 can be constituted of a field effect transistor F14*a*3, a resistor R14*a*3 and a capacitor C14*a*3. In more detail, a drain terminal of the field effect transistor F14*a*3 is connected to the power supply for outputting the voltage Vr and a source terminal thereof is connected to the electrode of the capacitance element CP. One end of the capacitor C14*a*3 and one end of the resistor R14*a*3 are connected to a gate electrode of the field effect transistor F14*a*3. The other end of the capacitor C14*a*3 is connected to the drain terminal of the field effect transistor F14*a*3. A signal or a voltage Vin for controlling ON/OFF of the switch element SW1 or SW2 is given between the other end of the resistor R14*a*3 and the source terminal of the field effect transistor F14*a*3.

Thus, by using the field effect transistor, it is possible to provide the round pulse generation circuits 14*a*31 and 14*a*32, i.e., the synthetic round pulse generation circuit 14*a*3 of high breakdown voltage and large permissible loss. Further, by using the field effect transistor, it is possible to reduce the size and lower the cost of the synthetic round pulse generation circuit 14*a*3.

(Synthetic Round Pulse Generation Circuit)

The synthetic round pulse generation circuit 14*a*3 can generate the following three types of basic ramp pulses by using the capacitance element CP.

First, the principle of generation of the ramp pulse in the synthetic round pulse generation circuit 14*a*3 will be discussed. When the capacitance element CP is charged with a constant current value i for a time Δt, the variation in voltage ΔV of the capacitance element CP is expressed as $$\Delta V=\Delta Q/CP=i\times\Delta t/CP$$

Therefore, a rate of change ΔV/Δt of the voltage ΔV with respect to time t is expressed as $$\Delta V/\Delta t(=dv/dt)=i/CP$$

At this time, since the current value i is constant, the rate of voltage change dv/dt is constant. Therefore, a ramp pulse having a constant rate of voltage change dv/dt can be obtained.

Figure 4:
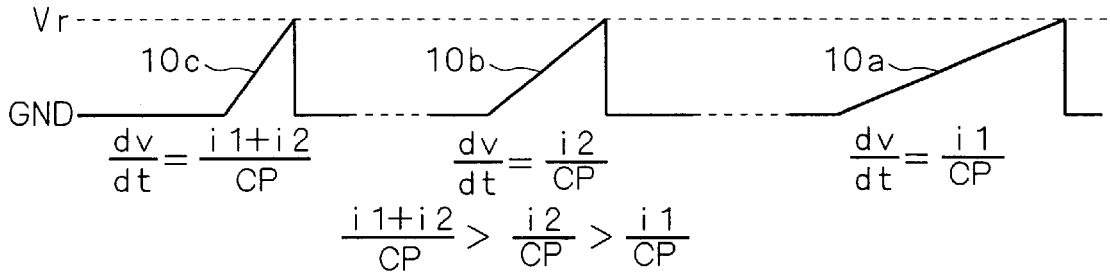
FIG. 4 is an illustration showing a synthetic round pulse in accordance with the first preferred embodiment of the present invention.

Since the synthetic round pulse generation circuit 14*a*3 comprises the constant current elements Iz1 and Iz2, three types of current values i1, i2 and (i1+i2) are applicable as the above current value i. The synthetic round pulse generation circuit 14*a*3 can thereby generate three types of ramp pulses 10*a* to 10*c* shown in FIG. 4.

Specifically, when the switch element SW1 is in an ON state and the switch element SW2 is in an OFF state, the ramp pulse 10*a* having the rate of voltage change of il/CP can be obtained. Further, when the switch element SW1 is in an OFF state and the switch element SW2 is in an ON state, the ramp pulse 10*b* having the rate of voltage change of i2/CP can be obtained. Furthermore, when both the switch elements SW1 and SW2 are in an ON state, the ramp pulse 10*c* having the rate of voltage change of {(i1+i2)/CP} can be obtained.

Since i2>i1 as discussed above, the relation {(i1+i2)/CP}>(i2/CP)>(i1/CP) holds. Therefore, the ramp pulse 10*c* which is obtained by supplying both the currents i1 and i2 in parallel rises fastest (whose inclination is the sharpest one), and the ramp pulse 10*a* obtained by supplying only the current i1 rises slowest (whose inclination is the gentlest one).

(Driving Method Using Synthetic Round Pulse)

Next, the synthetic round pulse generated and outputted by the synthetic round pulse generation circuit 14*a*3 will be discussed. FIGS. 5 to 8 are timing charts used for explaining first to third synthetic round pulses 11 to 13 in accordance with the first preferred embodiment. Waveforms of the voltages v(t) in FIGS. 5 to 8 are those of the synthetic round pulses 11 to 13, respectively. The synthetic round pulses 11 to 13 are each applicable as a priming discharge (and/or full writing (lighting) discharge) or a discharge to erase the wall charges. Further, the synthetic round pulses 11 to 13 are each applicable to weaken the discharge or accumulate a predetermined amount of wall charges. At this time, the synthetic round pulses 11 to 13 may be used in any point of time in a field.

(The First Synthetic Round Pulse)

Figure 5:
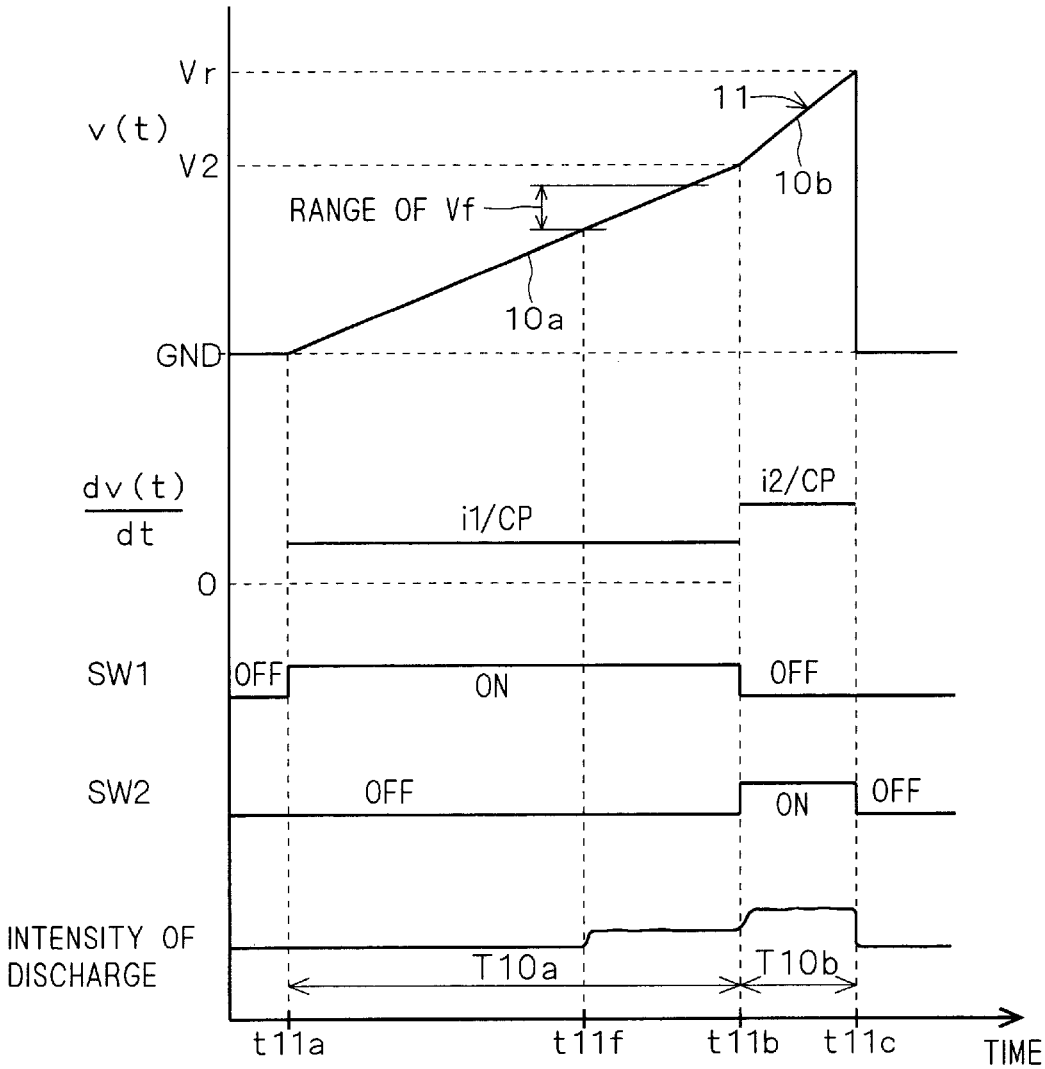
FIG. 5 is a timing chart used for explaining a first synthetic round pulse in accordance with the first preferred embodiment of the present invention.

First, FIG. 5 is a timing chart used for explaining the first synthetic round pulse 11. FIG. 5 shows waveforms of the rate of voltage change dv/dt, an ON/OFF control of the switch element SW1, an ON/OFF control of the switch element SW2 and the intensity of discharge, respectively.

As shown in FIG. 5, the synthetic round pulse 11 consists of the ramp pulse 10*a* having the rate of voltage change dv/dt=i1/CP and the ramp pulse 10*b* having the rate of voltage change dv/dt=i2/CP. In more detail, when the switch element SW1 is turned on and the switch element SW2 is turned off from time t11*a* to time t11*b*, the ramp pulse 10*a* is generated and outputted (see an application time period T10*a* of the ramp pulse 10*a*). After that, when the switch element SW1 is turned off and the switch element SW2 is turned on from time t11*b* to time t11*c*, the ramp pulse 10*b* is generated and outputted (see an application time period T10*b* of the ramp pulse 10*b*).

Thus, the synthetic round pulse generation circuit 14*a*3 generates the synthetic round pulse 11 by using (I) a system of generating the pulse by the round pulse generation circuit 14*a*31 (a first pulse generation system) and (II) a system of generating the pulse by the round pulse generation circuit 14*a*32 (a second pulse generation system). In more detail, a process step of generating the synthetic round pulse 11 and applying it to the electrode X comprises (i) a step of generating the ramp pulse (a first region) 10*a* by the round pulse generation circuit 14*a*31 and applying it to the electrode X (a first step or a step (a)) and (ii) a step of generating the ramp pulse (a second region) 10*b* by the round pulse generation circuit 14*a*32 and applying it to the electrode X (a second step or step (b)). Through this process step, the synthetic round pulse 11 which continuously changes from the ground potential (a first voltage) to the final voltage (a second voltage) Vr is applied to the electrode X.

In this case, the time t11*b* corresponds to a boundary point of time between the ramp pulses 10*a* and 10*b*, and at the time t11*b*, the rate of voltage change dv/dt discontinuously changes from i1/CP to i2/CP.

In particular, the lengths of the application time periods T10*a* and T10*b* are set so that the voltage v(t=t11*b*) (=V2) may have a value larger than that of the (maximum in the range of) firing voltage Vf, in other words, the discharge may be started with the ramp pulse 10*a*. Further, the voltage change of the ramp pulse 10*a* is set to be gentler than that of the ramp pulse 10*b* so that a sufficiently weak discharge can be reliably started at a discharge starting time t11*f* in the application time period T10*a*. In other words, the rate of voltage change dv/dt of the ramp pulse 10*a* is set to a small value.

Since (i2/CP)>(i1/CP) as discussed above, the rate of voltage change dv/dt increases after the time t11*b* when the synthetic round pulse 11 is used. It is proved, however, that the discharge continues without any influence even if the rate of voltage change dv/dt increases after the discharge starts. This can be discussed as below from the difference in discharge delay time.

In general, the discharge delay time is long in a case where the discharge is unstable, such as immediately after the discharge starts. In such a case, when a ramp pulse having a large rate of voltage change dv/dt is applied, the voltage v(t) sometimes exceeds the firing voltage Vf to be higher one at a point of time when the discharge is actually started.

In contrast to this, since a lot of space charges are generated by the discharge once the discharge is generated, the discharge becomes stable and the discharge delay time becomes short. Therefore, even the rate of voltage change dv/dt is relatively large in such a state, the discharge is quickly started at a point of time when the voltage exceeds the firing voltage Vf Specifically, unlike the above case where the discharge is unstable, the discharge starts until the voltage largely exceeds the firing voltage Vf Therefore, it is possible to continue a very weak discharge in which the characteristic feature of the round pulse lies, also in the application time period T10*b*. Further, since the rate of voltage change dv/dt in the application time period T10*b* is larger than that in the application time period T10*a*, the voltage can quickly reach the final voltage Vr.

With the first synthetic round pulse 11, it is possible to reduce the whole application time as compared with the case of using only the ramp pulse 10*a*. Further, since the discharge is started with the ramp pulse 10*a* having a small rate of voltage change dv/dt, it is possible to obtain the characteristic feature of the round pulse which lies in that deterioration in contrast can be suppressed by the very weak discharge and a constant amount of wall charges which depend on the final voltage Vr can be stably generated, as well as reduce the application time as discussed above.

Furthermore, the switching from the ramp pulse 10*a* to the ramp pulse 10*b* at the time t11*b* can be controlled precisely by performing the ON/OFF control of the switch elements SW1 and SW2. Therefore, it is possible to easily change the voltage V2 inaccordance with the discharge characteristics.

(The Second Synthetic Round Pulse)

Figure 6:
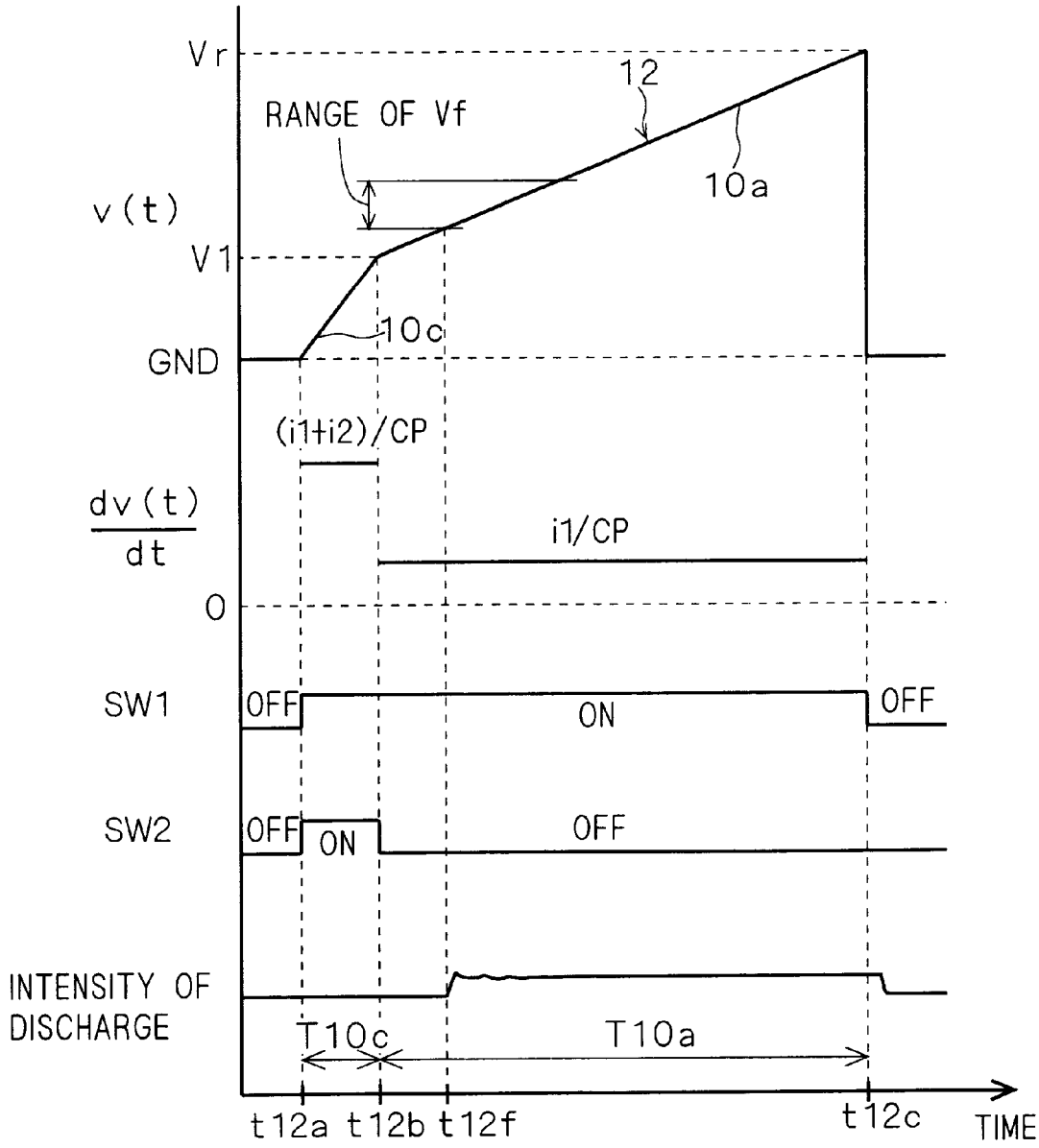
FIGS. 6 and 7 are timing charts used for explaining a second synthetic round pulse in accordance with the first preferred embodiment of the present invention.

Next, FIG. 6 is a timing chart used for explaining the second synthetic round pulse 12. FIG. 6 shows waveforms of the rate of voltage change dv/dt, an ON/OFF control of the switch element SW1, an ON/OFF control of the switch element SW2 and the intensity of discharge, respectively.

As shown in FIG. 6, the synthetic round pulse 12 consists of the ramp pulse 10*c* having the rate of voltage change dv/dt=(i1+i2)/CP and the ramp pulse 10*a* having the rate of voltage change dv/dt=i1/CP. In more detail, when both the switch elements SW1 and SW2 are turned on from time t12*a* to time t12*b*, the ramp pulse 10*c* is generated and outputted (see an application time period T10*c* of the ramp pulse 10*c*). After that, when the switch element SW1 is turned on and the switch element SW2 is turned off from time t12*b* to time t12*c*, the ramp pulse 10*a* is generated and outputted (see an application time period T10*a*).

Thus, the synthetic round pulse generation circuit 14*a*3 generates the synthetic round pulse 12 by using (I) a system of generating the pulse by the round pulse generation circuit 14*a*31 (the first pulse generation system) and (II) a system of generating the pulse by the round pulse generation circuits 14*a*31 and 14*a*32 (the second pulse generation system). In more detail, a process step of generating the synthetic round pulse 12 and applying it to the electrode X comprises (i) a step of generating the ramp pulse (the first region) 10*a* by the round pulse generation circuit 14*a*31 and applying it to the electrode X (the first step or a step. (a)) and (ii) a step of generating the ramp pulse (the second region) 10*c* by the round pulse generation circuits 14*a*31 and 14*a*32 and applying it to the electrode X (the second step or a step (b)). In the case of generating the synthetic round pulse 12, particularly, the first step is performed after the second step. Through this process step, the synthetic round pulse 12 which continuously changes from the ground potential (the first voltage) to the final voltage (the second voltage) Vr is applied to the electrode X.

In this case, the time t12*b* corresponds to a boundary point of time between the ramp pulses 10*c* and 10*a*, and at the time t12*b*, the rate of voltage change dv/dt discontinuously changes from (i1+i2)/CP to i1/CP.

In particular, the lengths of the application time periods T10*c* and T10*a* are set so that the voltage v(t=t12*b*) (=V1) may have a value smaller than that of the (minimum in the range of) firing voltage Vf, in other words, the discharge may be started with the ramp pulse 10*a*. Further, the rate of voltage change dv/dt (=i1/CP) of the ramp pulse 10*a* is set to a small value so that a sufficiently weak discharge can be reliably started at a discharge starting time t12*f* in the application time period T10*a*.

Furthermore, the rate of voltage change dv/dt (=(i1+i2)/CP) of the ramp pulse 10*c* is set to a small value. More specifically, the value (i1+i2)/CP of the rate of voltage change dv/dt is set so that a time needed to change the voltage from the ground potential GND to the final voltage Vr only with the round pulse 10*c* may be longer than the discharge delay time.

With the second synthetic round pulse 12, it is possible to produce the same effect as achieved with the first synthetic round pulse 11 as discussed above.

Further, with the second synthetic round pulse 12, the following effect can be produced. Such an effect will be discussed with reference to the timing chart of FIG. 7. Furthermore, FIG. 7 shows waveforms of the voltage v(t) of the synthetic round pulse 12 and the intensity of discharge, respectively.

Figure 7:
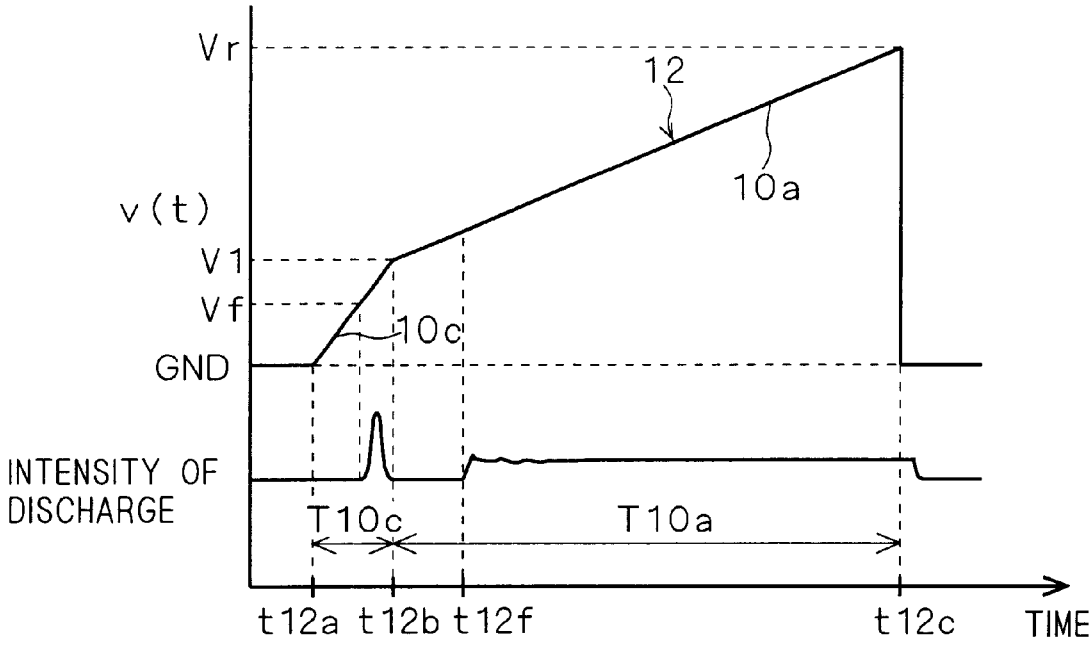

Herein a case where the discharge is started in the application time period T10*c*, in other words, a case of (the firing voltage Vf)<(the voltage V1) as shown in FIG. 7 will be considered. Examples of this state are a case where the firing voltage Vf of some of the discharge cells is significantly low out of the range of variation in firing voltage Vf for some reason, a case where the firing voltage Vf is lowered through time-varying change and the like.

In such a case, the voltage v(t) of the synthetic round pulse 12 exceeds the firing voltage Vf and the discharge is generated in the application time period T10*c*. Since this discharge is more intense than that is generated by the ramp pulse 10*a*, more wall charges than necessary are accumulated to suppress continuance of the discharge. Since the discharge is rather weaker than that by the rectangular wave, however, when the voltage v(t) becomes a certain voltage or higher in the application time period T10*a*, the voltage exceeds the firing voltage and a very weak discharge is generated again. This very weak discharge continues while the voltage changes and eventually the wall charges which depend on the final voltage Vr are accumulated like in the case where the discharge is started in the time period T10*a*.

Thus, with the second synthetic round pulse 12, the above-discussed characteristic feature of the round pulse can be obtained even if the discharge is started in the application time period T10*c*.

(The Third Synthetic Round Pulse)

Figure 8:
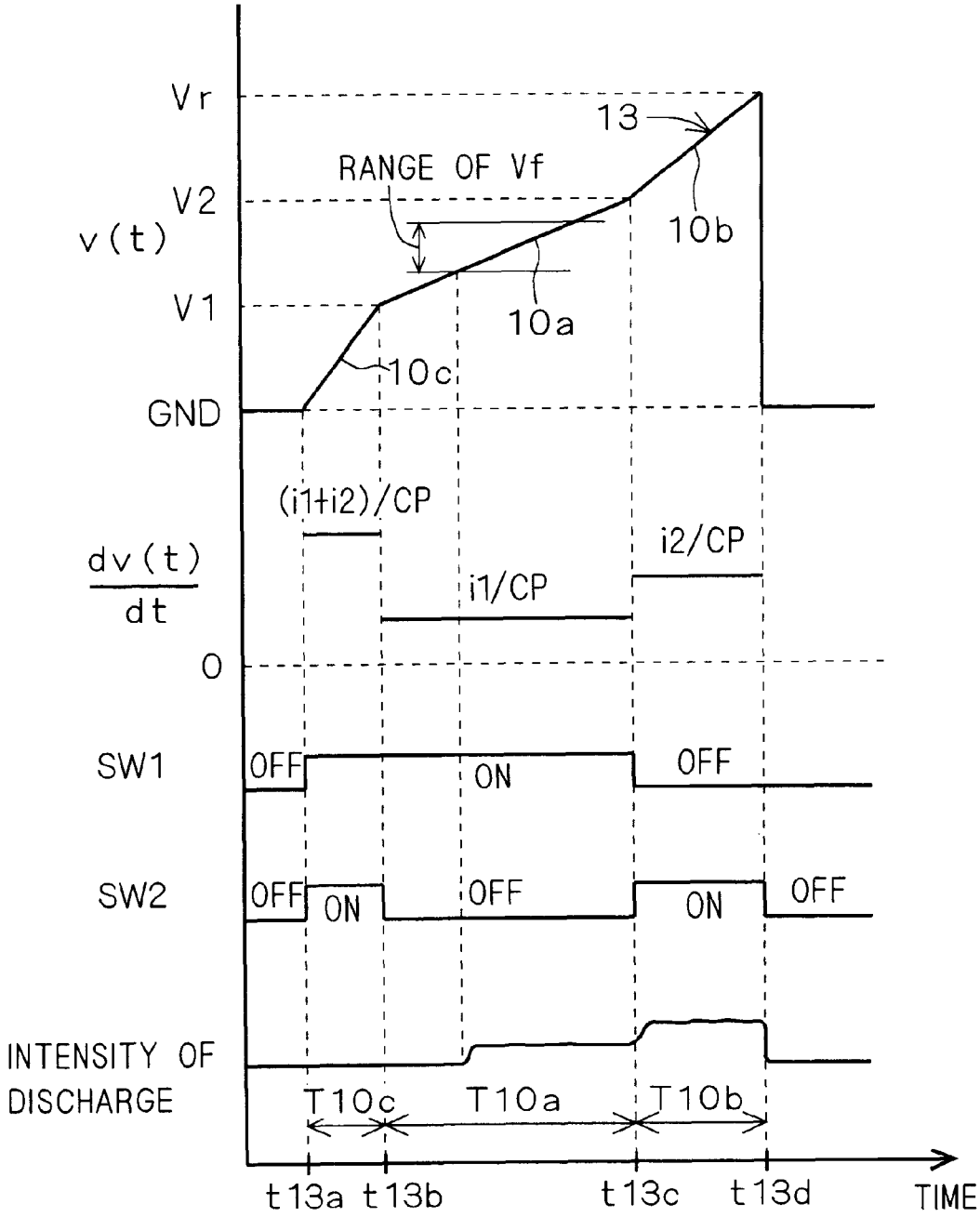
FIG. 8 is a timing chart used for explaining a third synthetic round pulse in accordance with the first preferred embodiment of the present invention.

Next, FIG. 8 is a timing chart used for explaining the third synthetic round pulse 13. FIG. 8 shows waveforms of the rate of voltage change dv/dt, an ON/OFF control of the switch element SW1, an ON/OFF control of the switch element SW2 and the intensity of discharge, respectively.

As shown in FIG. 8, the synthetic round pulse 13 consists of the ramp pulse 10*c* having the rate of voltage change dv/dt=(i1+i2)/CP, the ramp pulse 10*a* having the rate of voltage change dv/dt=i1/CP and the ramp pulse 10*b* having the rate of voltage change dv/dt=i2/CP. In more detail, when both the switch elements SW1 and SW2 are turned on from time t13*a* to time t13*b*, the ramp pulse 10*c* is generated and outputted (see an application time period T10*c*). After that, when the switch element SW1 is turned on and the switch element SW2 is turned off from time t13*b* to time t13*c*, the ramp pulse 10*a* is generated and outputted (see an application time period T10*a*). Subsequently, when the switch element SW1 is turned off and the switch element SW2 is turned on from time t13*c* to time t13*d*, the ramp pulse 10*b* is generated and outputted (see an application time period T10*b*).

Thus, the synthetic round pulse generation circuit 14*a*3 generates the ramp pulse (a third region) 10*b* by using (III) a system of generating the pulse by the round pulse generation circuit 14*a*32 (a third pulse generation system), besides the system of generating the second synthetic round pulse 12 (a third step or a step (c)). In the case of generating the third synthetic round pulse 13, the first step is performed between the third step and the second step. Through this process step, the synthetic round pulse 13 which continuously changes from the ground potential (the first voltage) to the final voltage (the second voltage) Vr is applied to the electrode X.

In this case, the time t13*b* corresponds to a boundary point of time between the ramp pulses 10*c* and 10*a*, and at the time t13*b*, the rate of voltage change dv/dt discontinuously changes from (i1+i2)/CP to i1/CP. Further, the time t13*c* corresponds to a boundary point of time between the ramp pulses 10*a* and 10*b*, and at the time t13*c*, the rate of voltage change dv/dt discontinuously changes from i1/CP to i2/CP.

In particular, the lengths of the application time periods T10*c*, T10*a* and T10*b* are set so that (the range of) the firing voltage Vf may have a value between the voltage v(t=t13*b*) (=V1) and the voltage v(t=t13*c*) (=V2), in other words, the discharge may be started with the ramp pulse 10*a*. Further, the rate of voltage change dv/dt (=i1/CP) of the ramp pulse 10*a* is set to a small value so that a sufficiently weak discharge can be reliably started at a discharge starting time in the application time period T10*a*.

With the third synthetic round pulse 13, it is possible to produce the same effect as achieved with the first and second synthetic round pulses 11 and 12 as discussed above. In particular, since the ramp pulses 10*c* and 10*b* having the rates of voltage change dv/dt larger than that of the ramp pulse 10*a* are used before and after the start of discharge, it is possible to further reduce the whole application time as compared with the cases of the first and second synthetic round pulses 11 and 12.

Further, a common pulse may be used as the ramp pulses applied before and after the ramp pulse 10*a*, only if its rate of voltage change dv/dt is larger than the rate of voltage change dv/dt=i1/CP, within a range where no trouble is caused in the respective operations. For example, the ramp pulse 10*b* may be applied in common before and after the ramp pulse 10*a*, or the ramp pulse 10*c* may be applied in common before and after the ramp pulse 10*a*. In this case, when the ramp pulse 10*c* is applied in common before and after the ramp pulse 10*a*, since it is not necessary to concurrently perform the ON/OFF control for a plurality of switch elements SW1 and SW2 at the time t13*b* and the time t13*c*, it is possible to further facilitate the timing for controlling the switch elements.

Though the above discussion is made on the case where the synthetic round pulse generation circuit 14*a*3 comprises the two round pulse generation circuits 14*a*31 and 14*a*32, by providing more round pulse generation circuits and combining outputs from the circuits, it is possible to generate and output more types of synthetic round pulses. If N (natural number) round pulse generation circuits are provided, $(2^N-1)$ types of ramp pulses can be generated at the maximum.

<The Second Preferred Embodiment>

(Synthetic Round Pulse Generation Circuit)

Figure 9:
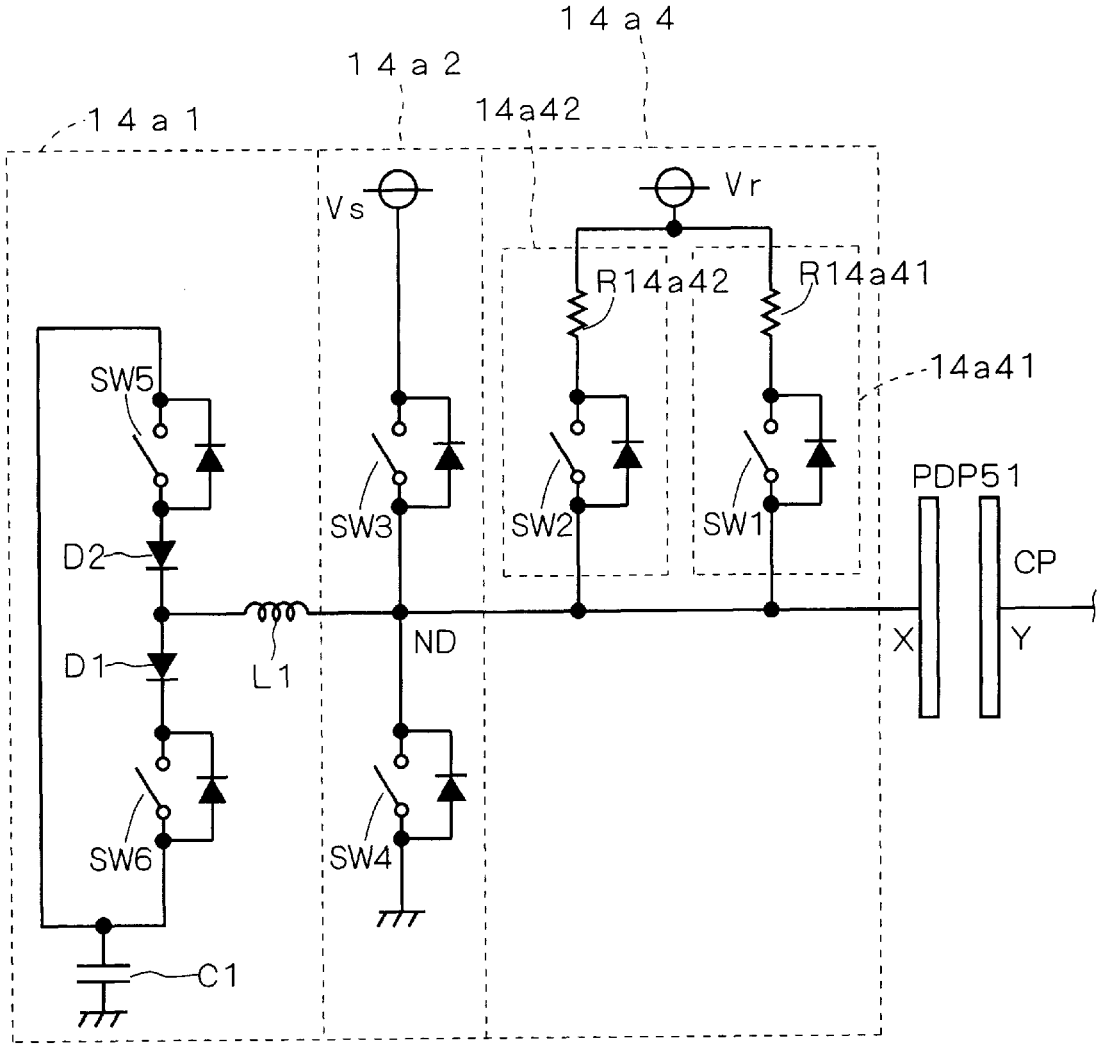
FIG. 9 is a circuit diagram showing a driving device for the plasma display panel in accordance with a second preferred embodiment of the present invention.

FIG. 9 is a circuit diagram showing the X driver 14*a* in accordance with the second preferred embodiment. As shown in FIG. 9, the X driver 14*a* includes the recovery circuit 14*a*1 and sustain circuit 14*a*2 discussed earlier, and a synthetic round pulse generation circuit 14*a*4 in accordance with the second preferred embodiment.

The synthetic round pulse generation circuit 14*a*4 includes two round pulse generation circuits 14*a*41 and 14*a*42. As can be seen from the comparison with the above discussed round pulse generation circuits 14*a*31 and 14*a*32 (see FIG. 2), the round pulse generation circuits 14*a*41 and 14*a*42 comprise resistors R14*a*41 and R14*a*42, instead of the constant current elements Iz1 and Iz2, respectively. Herein, it is assumed that the resistance value R14*a*41 is larger than the resistance value R14*a*42.

Figure 10:
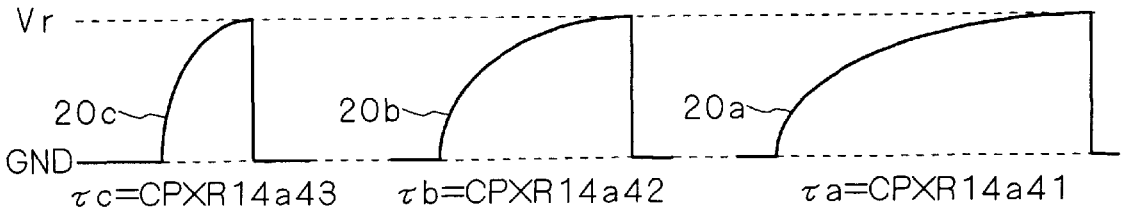
FIG. 10 is an illustration showing a synthetic round pulse in accordance with the second preferred embodiment of the present invention.

The synthetic round pulse generation circuit 14*a*4 can generate three types of basic CR pulses 20*a* to 20*c* as shown in FIG. 10 by using the capacitance element CP and the resistances R14*a*41 and R14*a*42.

Specifically, when the switch element SW1 is in an ON state and the switch element SW2 is in an OFF state, the CR pulse 20*a* having a time constant (corresponding to voltage change) $\tau$ a which depends on the capacitance element CP and the resistance R14*a*41, being expressed as $\tau a = CP \times R14a41$. Further, when the switch element SW1 is in an OFF state and the switch element SW2 is in an ON state, the CR pulse 20*b* having a time constant $\tau b$ which depends on the capacitance element CP and the resistance R14*a*42, being expressed as τb=CP×R14*a*42. Furthermore, when both the switch elements SW1 and SW2 are in an ON state, the CR pulse 20*c* having a time constant τc which depends on the capacitance element CP and a parallel synthetic resistance (value) R14*a*43 consisting of the resistances R14*a*41 and R14*a*42, being expressed as τc=CP×R14*a*43, where R14*a*43=R14*a*41×R14*a*42/(R14*a*41 +R14*a*42).

Since (the resistance R14*a*41)>(the resistance R14*a*42) as discussed above, the relation (the time constant τc)<(the time constant τb)<(the time constant τa) holds. Therefore, the CR pulse 20*c* rises fastest (whose inclination is the sharpest one), and the ramp pulse 20*a* rises slowest (whose inclination is the gentlest one).

(Driving Method Using Synthetic Round Pulse)

Figure 11:
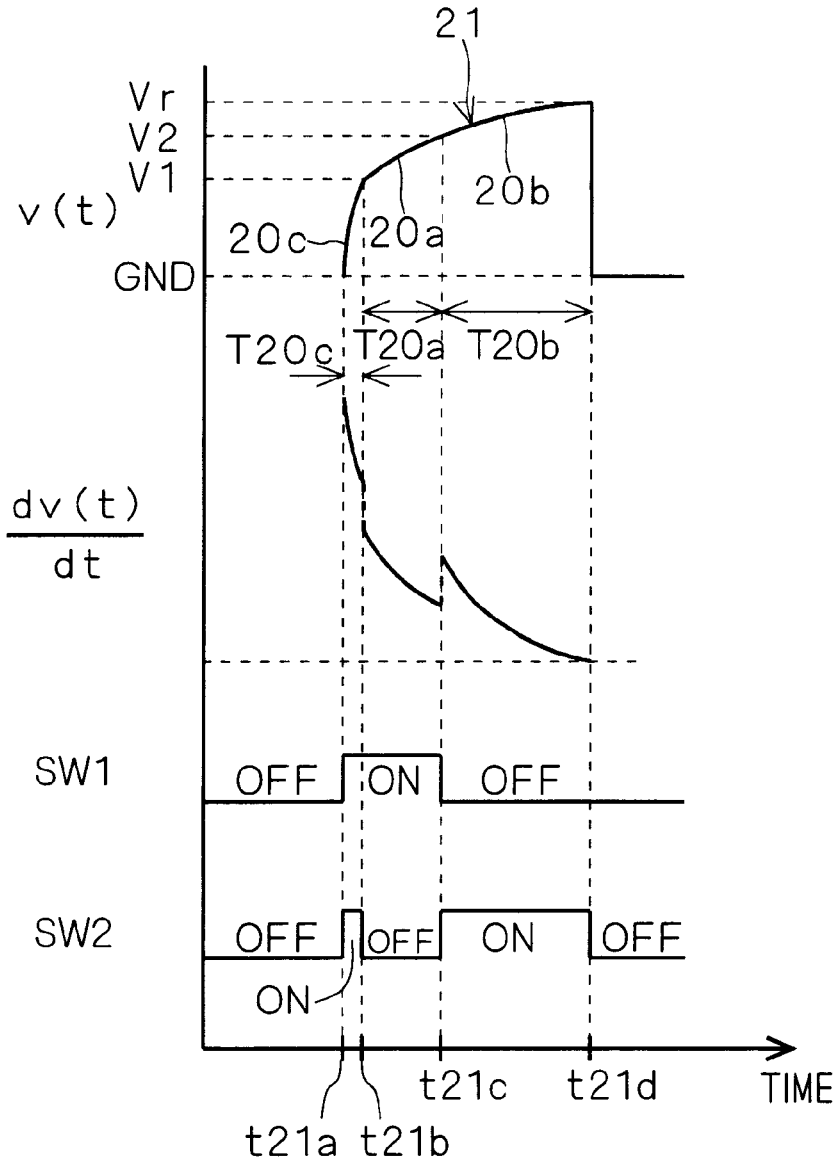
FIG. 11 is a timing chart used for explaining a synthetic round pulse in accordance with the second preferred embodiment of the present invention.

Next discussion will be made on the synthetic round pulse generated and outputted by the synthetic round pulse generation circuit 14*a*4. FIG. 11 is a timing chart used for explaining a synthetic round pulse 21 in accordance with the second preferred embodiment. FIG. 11 shows waveforms of the voltage v(t) of the synthetic round pulse 21, the rate of voltage change dv/dt, an ON/OFF control of the switch element SW1, an ON/OFF control of the switch element SW2 and the intensity of discharge, respectively.

As shown in FIG. 11, the synthetic round pulse 21 consists of the CR pulse 20*c* having the time constant τc, the CR pulse 20*a* having the time constant τa and the CR pulse 20*b* having the time constant τb. In more detail, when both the switch elements SW1 and SW2 are turned on from time t21*a* to time t21*b*, the CR pulse 20*c* is generated and outputted (see an application time period T20*c* of the CR pulse 20*c*). After that, when the switch element SW1 is turned on and the switch element SW2 is turned off from time t21*b* to time t21*c*, the CR pulse 20*a* is generated and outputted (see an application time period T20*a* of the CR pulse 20*a*). Subsequently, when the switch element SW1 is turned off and the switch element SW2 is turned on from time t21*c* to time t21*d*, the CR pulse 20*b* is generated and outputted (see an application time period T20*b* of the CR pulse 20*b*).

Thus, the synthetic round pulse generation circuit 14*a*4 generates the synthetic round pulse 21 using (I) a system of generating the pulse by the round pulse generation circuit 14*a*41 (the first pulse generation system), (II) a system of generating the pulse by the round pulse generation circuit 14*a*42 (the second pulse generation system) and (III) a system of generating the pulse by the round pulse generation circuits 14*a*41 and 14*a*42 (the third pulse generation system). In more detail, a process step of generating the synthetic round pulse 21 and applying it to the electrode X comprises (i) a step of generating the CR pulse (the first region) 20*a* by the round pulse generation circuit 14*a*41 and applying it to the electrode X (the first step or step (a)), (ii) a step of generating the CR pulse (the second region) 20*b* by the round pulse generation circuit 14*a*42 and applying it to the electrode X (the second step or step (b)) and (iii) a step of generating the CR pulse (the third region) 20*c* by the round pulse generation circuits 14*a*41 and 14*a*42 and applying it to the electrode X (the third step of step (c)). In the case of generating the synthetic round pulse 21, the first step is performed between the third step and the second step. Through this process step, the synthetic round pulse 21 which continuously changes from the ground potential (the first voltage) to the final voltage (the second voltage) Vr is applied to the electrode X.

In particular, the lengths of the application time periods T20*c*, T20*a* and T20*b* and the resistance values R14*a*1 and R14*a*2 are set so that (the range of the firing voltage Vf may have a value between the voltage v(t=t21*b*) (=V1) and the voltage v(t=t21*c*) (=V2).

With the synthetic round pulse 21, since the CR pulses 20*c* and 20*b* having the time constants which are smaller than the time constant τa are used before and after the start of discharge, it is possible to further reduce the whole application time as compared with the case of using only the CR pulse 20*a*.

Also with the synthetic round pulse 21, it is possible to obtain the characteristic feature of the round pulse which lies in that deterioration in contrast can be suppressed by the very weak discharge and a constant amount of wall charges which depend on the final voltage Vr can be stably generated.

In particular, the round pulse generation circuits 14*a*41 and a14*a*42, which generate the CR pulses by using the resistances R14*a*41 and R14*a*42, each have a circuit configuration simpler than that of the above-discussed round pulse generation circuits 14*a*31 and 14*a*32. The power is consumed in the resistor R14*a*41 and/or the resistor R14*a*42 when the synthetic round pulse 21 is applied. Since the resistance having a large permissible loss can be prepared at relatively low cost, it is possible to provide the round pulse generation circuits 14*a*41 and 14*a*42, i.e., the synthetic round pulse generation circuit 14*a*4 at low cost.

Further, both before and after the CR pulse 20*a*, the CR pulse 20*b* may be applied or the CR pulse 20*c* may be applied.

Further, with the synthetic round pulse generation circuit 14*a*4, it is possible to generate and output a synthetic round pulse consisting of a CR pulse having a small time constant and a CR pulse having a large time constant which are combined in this order or a synthetic round pulse consisting of these pulses in the reverse order.

Furthermore, by further providing a circuit which corresponds to the round pulse generation circuit 14*a*41 or 14*a*42 and combining outputs from the circuits, it is possible to generate and output more types of synthetic round pulses. If N (natural number) round pulse generation circuits, i.e., N resistors are provided, $(2^N-1)$ types of CR pulses can be generated at the maximum.

<The Third Preferred Embodiment>

Figure 19:
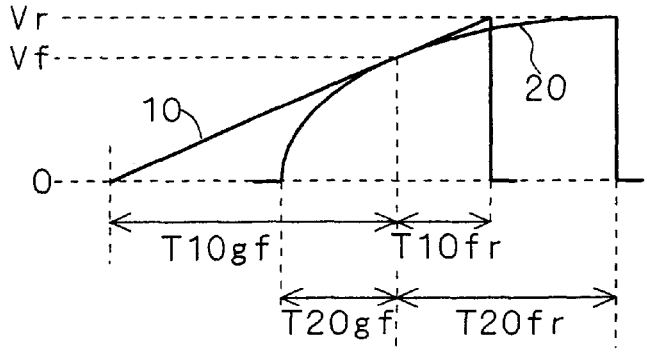
FIG. 19 PRIOR ART
FIG. 19 is an illustration showing a ramp waveform and a CR waveform.
Figure 20:
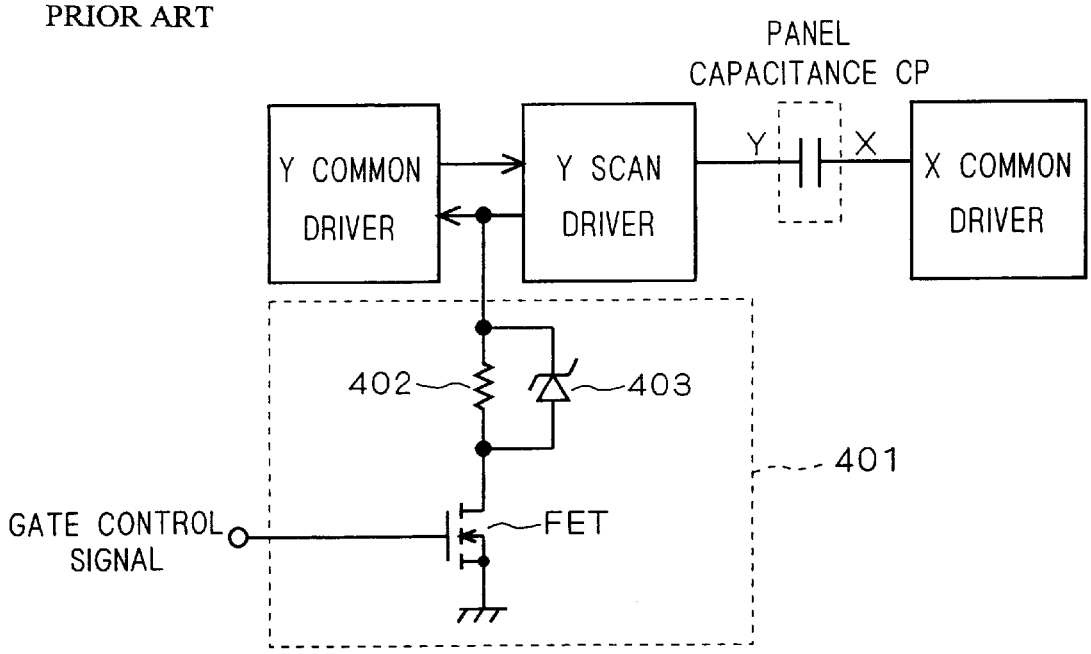
FIG. 20 PRIOR ART
FIG. 20 is a block diagram showing a round pulse generation circuit in the background art.
Figure 21:
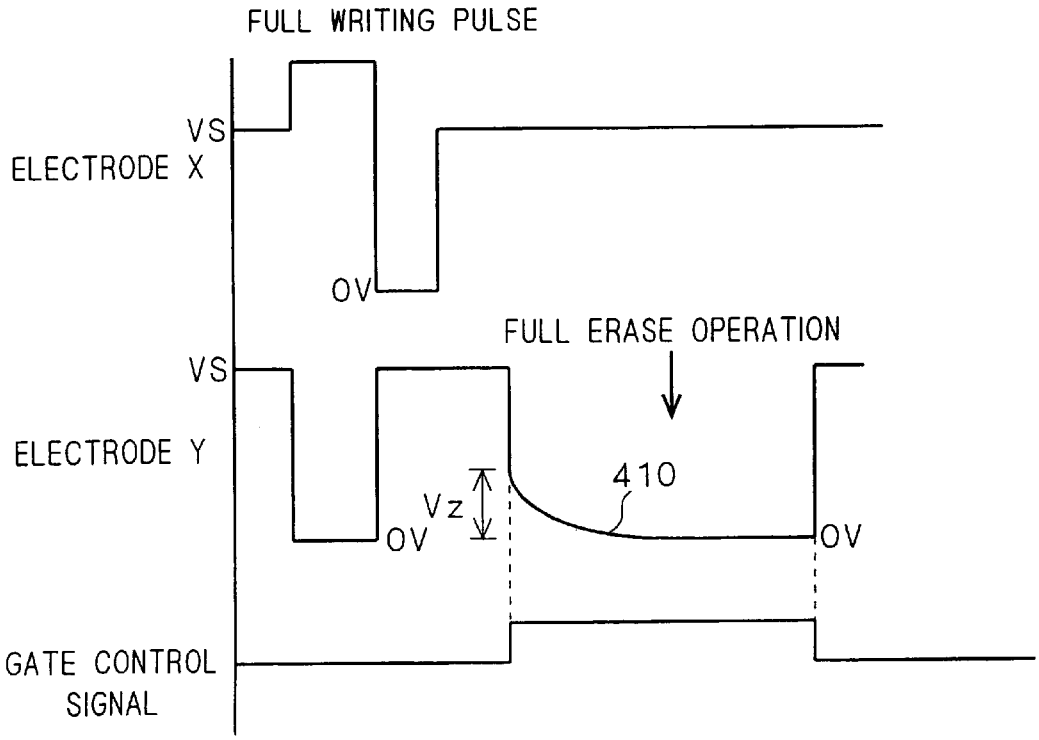
FIG. 21 PRIOR ART
FIG. 21 is a timing chart used for explaining a method of driving the round pulse generation circuit in the background art.

In the first and second preferred embodiments, the case where a plurality of ramp pulses or CR pulses are combined to constitute the synthetic round pulse has been discussed. As discussed above, it takes a long time for the voltage by the ramp pulse to reach the firing voltage Vf while it takes a long time for the voltage by the CR pulse to approximate the final voltage Vr from the firing voltage Vf (see FIG. 19). Considering this, a synthetic round pulse consisting of CR pulse and ramp pulse will be discussed in the third preferred embodiment.

Figure 12:
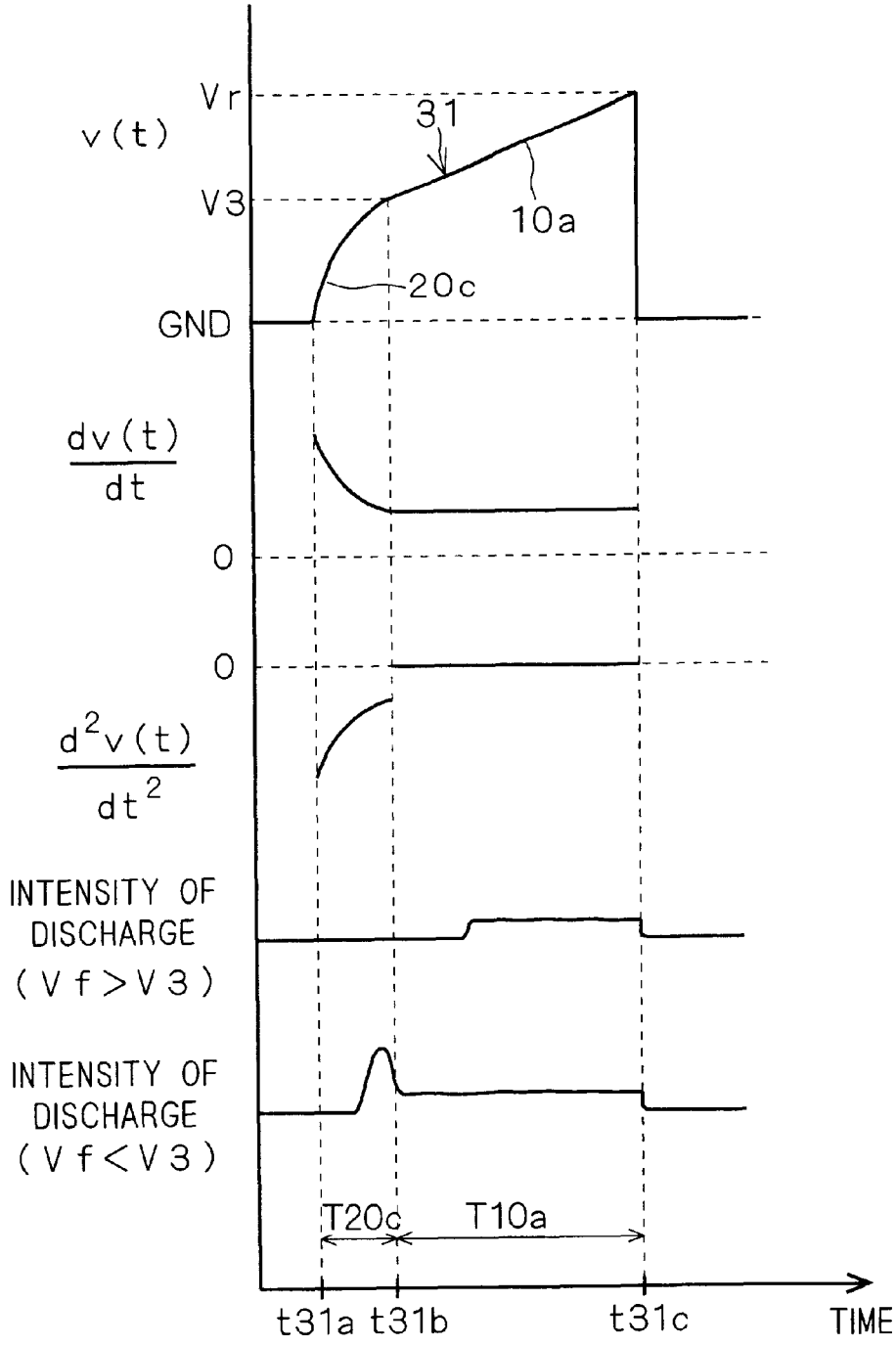
FIG. 12 is a timing chart used for explaining a synthetic round pulse in accordance with a third preferred embodiment of the present invention.

FIG. 12 is a timing chart used for explaining a synthetic round pulse 31 in accordance with the third preferred embodiment. FIG. 12 shows waveforms of the voltage v(t) of the synthetic round pulse 31, the rate of voltage change dv/dt, second differential $d^2v(t)/dt^2$ of the voltage v(t) with respect to time t, the intensity of discharge in a case of (the firing voltage Vf)>(the voltage V3 (discussed later)) and the intensity of discharge in a case of (the firing voltage Vf)<(the voltage V3), respectively.

As shown in FIG. 12, the synthetic round pulse 31 consists of the above-discussed CR pulse (the second region) 20*c* and the ramp pulse (the first region) 10*a*. In more detail, the CR pulse 20*c* is generated and outputted from the time t31*a* to the time t31*b*, and then the ramp pulse 10*a* is generated and outputted from the time t31*b* to the time t31*c*.

The synthetic round pulse 31 can be generated by, e.g., a synthetic round pulse generation circuit which is obtained by adding the round pulse generation circuit 14*a*31 to the synthetic round pulse generation circuit 14*a*4 (see FIG. 9). In this case, the system of generating the pulse by the round pulse generation circuit 14*a*31 corresponds to the first pulse generation system and the system of generating the pulse by both the round pulse generation circuits 14*a*41 and 14*a*42 corresponds to the second pulse generation system.

In this case, the time t31*b* corresponds to a boundary point of time between the CR pulse 20*c* and the ramp pulse 10*a*. In the third preferred embodiment, the rate of voltage change dv/dt of the CR pulse 20*c* and the rate of voltage change dv/dt of the ramp pulse 10*a* at the time t31*b* are set to the same value and the rate of voltage change dv/dt thereby gently shifts. Further, the application time periods T20*c*, T10*a* and the like may be set so that the rate of voltage change dv/dt may be discontinuously changed at the time t31*b*.

With the synthetic round pulse 31, it is possible to start a very weak discharge with the gentle rate of voltage change dv/dt of the ramp pulse 10*a* when the firing voltage Vf is larger than the voltage v(t=t31*b*) (=V3). It is also possible to reduce the application time of the pulse with the sharp rise of the CR pulse 20*c*.

Further, since the rate of voltage change dv/dt gently shifts at the time t31*b*, it is possible to smoothly shift from an intense discharge in the application time period T20*c* to a very weak one in the application time period T10*a* even when the firing voltage Vf is lower than the voltage V3, for the same reason as the case of the synthetic round pulse 12 (see FIG. 7).

Even if the rate of voltage change dv/dt has no intermittent point, the second differential $d^2v(t)/dt^2$ of the voltage v(t) discontinuously changes at the time t31*b*, and it can be seen that the synthetic round pulse consists of different round pulses with the time t31*b* used as a boundary.

Further, after the discharge is started, if the ramp pulse 10*b* and the like having the rate of voltage change dv/dt larger than that of the ramp pulse 10*a* is used, the application time can be further reduced.

Furthermore, though the above discussions have been made on the case where the pulses 11 to 13, 21 and 31 each have a positive polarity, there may be a case where the pulses 11 to 13, 21 and 31 each have a negative polarity. This can apply to pulses 32 and 33 discussed later.

<Variation of the First to Third Preferred Embodiments>

With the round pulse, it is possible to generate a constant amount of wall charges which depend on the final voltage Vr even if there is variation in discharge characteristics of the discharge cells. Therefore, it is worthful to use the round pulse as a pulse for controlling the amount of wall charges. This is also valid for the synthetic round pulse.

Figure 13:
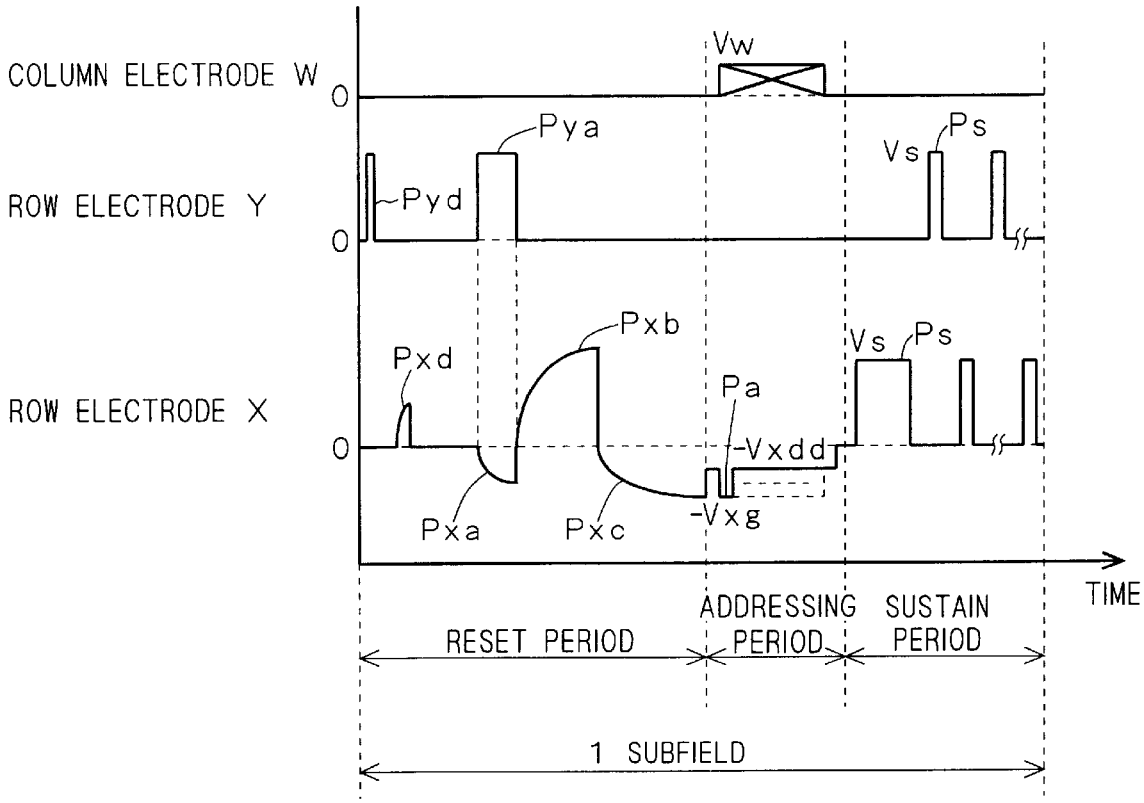
FIG. 13 is a timing chart used for explaining a method of driving a plasma display panel in accordance with a first variation in common to the first to third preferred embodiments of the present invention.

FIG. 13 is a timing chart used for explaining a method of driving a plasma display panel in accordance with the first variation. FIG. 13 shows waveforms of voltages applied to the electrodes W, Y and X, respectively. As shown in FIG. 13, in the present driving method, one subfield is divided into the reset period, the addressing period and the sustain period.

In the reset period, first, a rectangular pulse Pyd of positive polarity having a narrow width is applied to the row electrode Y and subsequently a round pulse (herein, a CR pulse) Pxd of positive polarity is applied to the row electrode X. With the CR pulse Pxd, a discharge which is weaker than that with the rectangular pulse is generated only in the discharge cells which are lighted in the immediately preceding subfield, to reduce the wall charges of the discharge cells.

After that, a rectangular pulse Pya of positive polarity is applied to all the row electrodes Y and a round pulse Pxa of negative polarity is applied to all the row electrodes X, to perform a full lighting (full writing). At this time, since the wall charges in the discharge cells which are lighted in the immediately preceding subfield are reduced by the discharge with the above CR pulse Pxd, this full writing discharge is weaker than that in a case of not applying the CR pulse Pxd. Further, the full writing discharge is weaker than that in a case of applying the rectangular pulse instead of the CR pulse Pxa. Next, a CR pulse Pxb of positive polarity is applied to all the row electrodes X, to perform the erase operation all over the PDP 51.

Subsequently, a synthetic round pulse Pxc of negative polarity (e.g., like the synthetic round pulse 21) is applied to all the row electrodes X to generate a discharge, thereby controlling the amount of wall charges. At this time, the rate of voltage change dv/dt of the synthetic round pulse Pxc is set to be sufficiently gentle. Since this allows an appropriate control of the amount of wall charges immediately before the addressing period, the operation in the addressing period is made reliable and a sufficient operating margin can be ensured. Further, as the above pulses Pxa, Pxb and Pxd, the synthetic round pulses may be used.

Next, in the addressing period, a bias voltage (−Vxdd) is applied to all the row electrodes X and then an address pulse Pa of a voltage (−Vxg) is applied to predetermined row electrodes X in accordance with a scanning. In this scanning, a voltage Vw or 0 (V) corresponding to inputted image data is applied to the column electrodes W. In the sustain period after that, the sustain pulse Ps is applied alternatingly to all the row electrodes X and all the row electrodes Y a predetermined number of times.

<The Fourth Preferred Embodiment>

Figure 14:
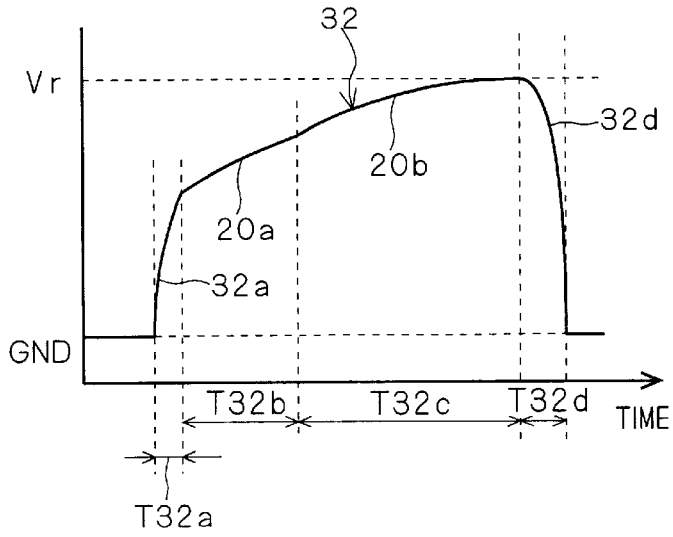
FIG. 14 is a waveform chart used for explaining a synthetic round pulse in accordance with a fourth preferred embodiment of the present invention.

In the fourth preferred embodiment, discussion will be made on a method of generating a synthetic round pulse by using the power recovery circuit 14*a*1 (see FIGS. 2 and 9) which is used in the background-art driving method to recover the reactive power at the time when the sustain pulse is applied. FIG. 14 is a waveform chart used for explaining a synthetic round pulse 32 in accordance with the fourth preferred embodiment. Herein, discussion will be made also referring to above-discussed FIG. 9, and it is assumed that the recovery capacitor C1 has been charged with a predetermined voltage in advance.

First, in time period T32*a*, a voltage is supplied to the PDP 51 or the capacitance element CP from the recovery circuit 14*a*1. Specifically, by turning the switch element SW5 on, a current flows into the capacitance element CP from the recovery capacitor C1 through the switch element SW5 and the recovery coil L1. At this time, the resistance elements such as the recovery coil L1, the capacitance element CP, the internal resistance (not shown) of the switch element SW5 and the like constitute an LCR series resonant circuit. Since the resistance element is relatively small, the above LCR series resonant circuit can be regarded as an LC resonant circuit, and an LC resonant waveform (or LC resonant pulse) 32*a* generated by the LC resonant circuit is applied to the PDP 51.

After that, in sequentially-subsequent time periods T32*b* and T32*c*, the switch element SW5 is turned off. Then, like in the driving method of the second preferred embodiment, the CR pulse 20*a* is generated in the time period T32*b* and the CR pulse 20*b* is generated in the time period T32*c*.

Next, in time period T32*d*, the synthetic round pulse 32 falls through the recovery circuit 14*a*1. Specifically, by turning the switch element SW6 on, a current is carried to the recovery capacitor C1 through the recovery coil L1 and the switch element SW6, to generate an LC resonant pulse 32*d*. Finally, by turning the switch element SW4 on, the potential of the electrode on the left side of the capacitance element CP is brought into the ground potential (GND).

By the present driving method, it is possible to reduce the reactive power which is not concerned in the display and utilize the power recovered by the recovery circuit 14*a*1 for generation of the synthetic round pulse. Further, the above-discussed ramp pulse 10*a* and the like may be generated in the time periods T32*b* and T32*c*. Furthermore, different types of round pulses may be generated in the time periods T32*b* and T32*c*, such as the CR pulse is generated in the time period T32*b* while the ramp pulse is generated in the time period T32*c*.

Further, depending on the setting of the sustain voltage Vs, the discharge is sometimes started in the time periods T32*a*, in other words, the discharge is sometimes started by a charging voltage of the recovery capacitor C1. In such a case, it is only necessary to cut off the current flowing from the recovery circuit 14*a*1 by reducing the ON time of the switch element SW5.

<The Fifth Preferred Embodiment>

Figure 15:
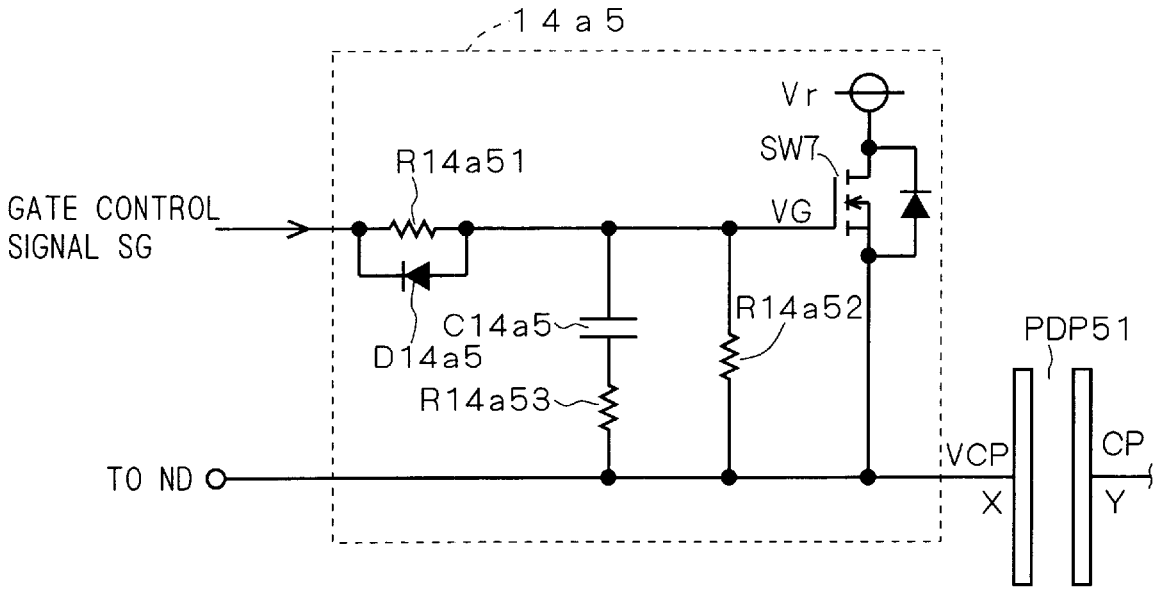
FIG. 15 is a circuit diagram showing an acceleration pulse generation circuit in accordance with a fifth preferred embodiment of the present invention.

FIG. 15 is a circuit diagram showing an acceleration pulse generation circuit 14*a*5 in accordance with the fifth preferred embodiment. Herein, a waveform (pulse) to gradually increase the absolute value of the rate of voltage change dv/dt is termed an acceleration waveform (or acceleration (voltage) pulse). The acceleration pulse generation circuit 14*a*5 is provided in the X driver 14*a*, replacing the synthetic round pulse generation circuit 14*a*3 of FIG. 2 or the synthetic round pulse generation circuit 14*a*4 of FIG. 9.

As shown in FIG. 15, the acceleration pulse generation circuit 14*a*5 comprises a switch element SW7 including e.g., an N-type MOS field effect transistor between the power supply for outputting the voltage Vr and the electrode on the left side of the capacitance element CP. One end of a resistor 14*a*51 is connected to a gate terminal of the field effect transistor and a gate control signal SG is inputted to the other end of the resistor 14*a*51. One end of the resistor 14*a*51 is connected to an anode of a diode D14*a*5 and a cathode of the diode D14*a*5 is connected to the other end of the resistor 14*a*51. A resistor 14*a*52 is connected between one end of the resistor 14*a*51 and the electrode on the left side of the capacitance element CP. Further, a series circuit consisting of a capacitor C14*a*5 and a resistor R14*a*53 is connected between one end of the resistor R14*a*51 and the electrode on the left side of the capacitance element CP, on the side of the resistor R14*a*51 relative to the resistor R14*a*52.

Figure 16:
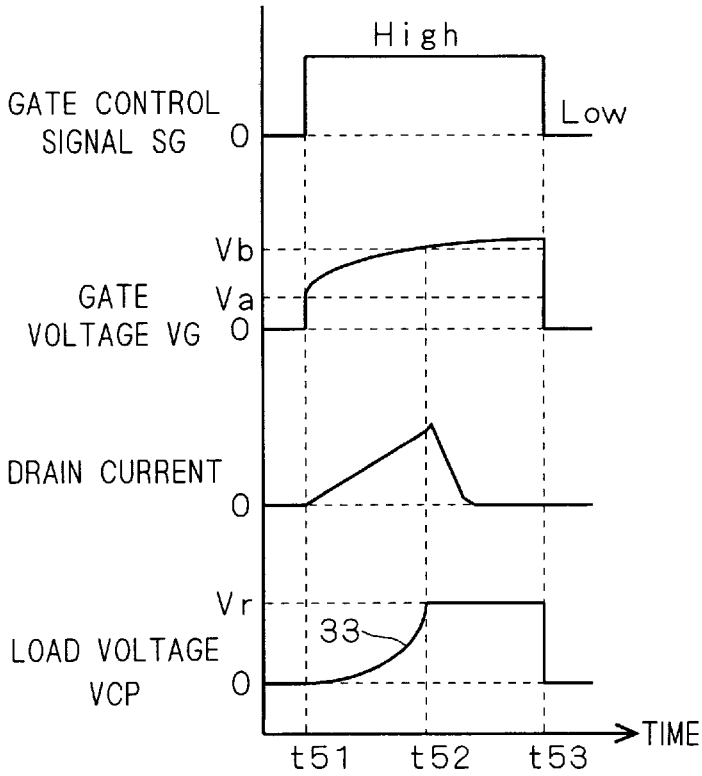
FIG. 16 is a timing chart used for explaining a method of driving a plasma display panel in accordance with the fifth preferred embodiment of the present invention.
Figure 17:
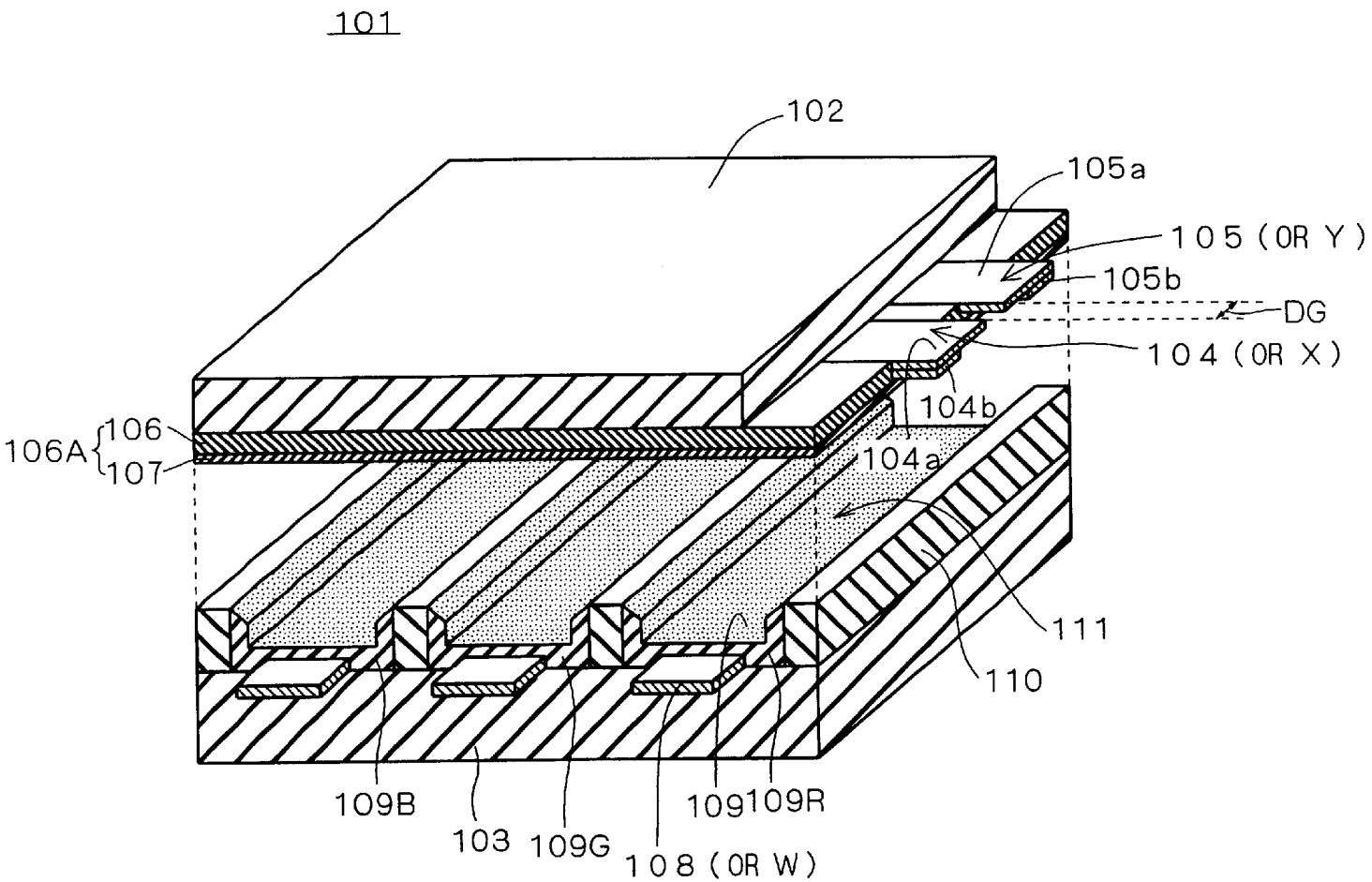
FIG. 17 PRIOR ART
FIG. 17 is a perspective view showing a structure of a plasma display panel in the background art.
Figure 18:
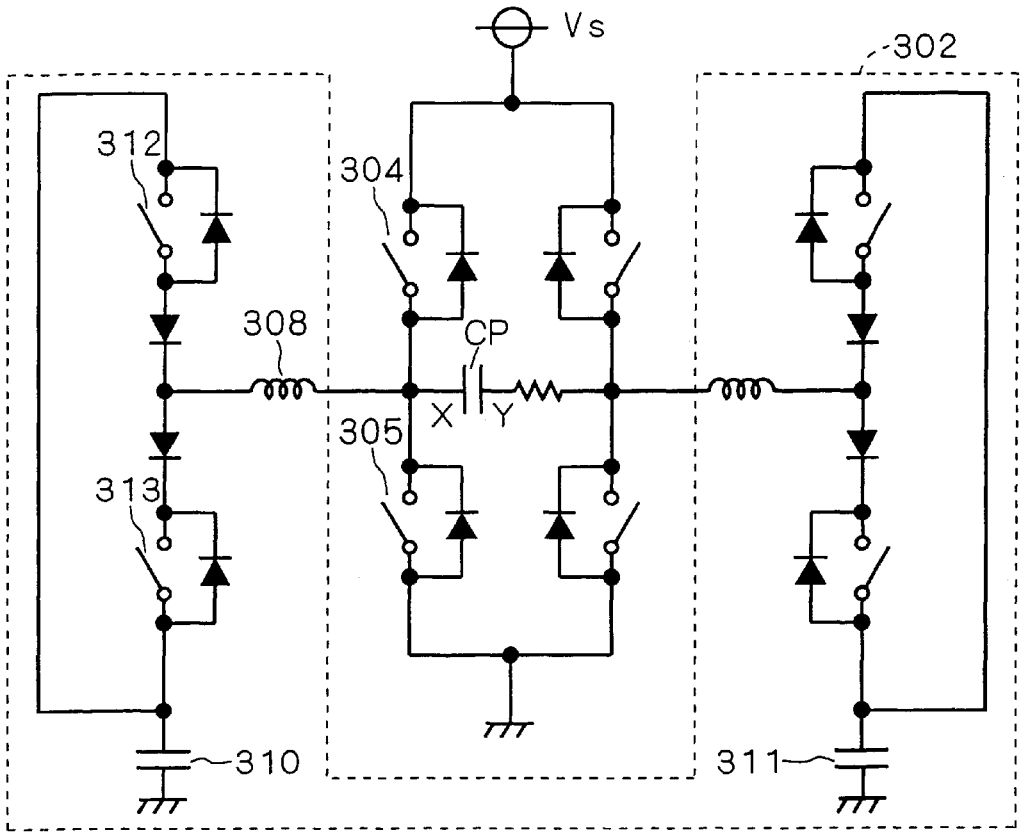
FIG. 18 PRIOR ART
FIG. 18 is a circuit diagram showing a power recovery circuit in the background art.

FIG. 16 is a timing chart used for explaining an operation of the acceleration pulse generation circuit 14*a*5 or a driving method in accordance with the fifth preferred embodiment. Further, FIG. 16 shows waveforms of the gate control signal SG, a gate voltage VG of the above field effect transistor, a drain current and a load voltage (or a voltage of the electrode X) VCP. The field effect transistor has a threshold voltage and the present driving method uses a phenomenon that the drain current (value) is limited until the gate voltage VG reaches a predetermined voltage while the drain current rapidly flows at the point of time when the gate voltage VG reaches the predetermined voltage.

When the gate control signal SG is shifted from LOW to HIGH at time t51, a voltage Va is applied to the gate terminal (the gate voltage VG=Va). Further, the voltage Va is obtained by dividing a voltage for gate control by (a) the resistor R14*a*51 and (b) a parallel circuit constituted of the resistor R14*a*52 and the series circuit consisting of the capacitor C14*a*5 and the resistor 14*a*53, not higher than the threshold voltage of the field effect transistor. When the gate voltage VG=Va, the field effect transistor does not open (is not turned on) and therefore no drain current flows.

After that, when a current begins to flow towards the capacitor C14*a*5, the gate voltage VG rises with a CR time constant and the field effect transistor gradually opens. As the field effect transistor shifts from an OFF state to an ON state, the internal resistance of the field effect transistor gradually decreases and the drain current gradually increases while being limited by the internal resistance.

Then, at time t52, when the gate voltage VG becomes a voltage Vb, the field effect transistor is completely turned on. At this time, the voltage VCP of the capacitance element CP acceleratedly increases (an acceleration pulse 33) as the time approaches the time t52. The drain current flows into the capacitance element CP so that the capacitance element CP may be completely charged, and after the charge is completed, no drain current flows.

Next, when the gate control signal SG is shifted from HIGH to LOW at time t53, the gate voltage VG quickly falls by the discharge through the diode D14*a*5.

Thus, the acceleration pulse 33 continuously changes from the ground potential (the first voltage) to the final voltage Vr (the second voltage), and the voltage change becomes sharper as it approaches the voltage Vr.

With the acceleration pulse 33, the discharge is started in a region where its inclination is gentle or its rate of voltage change dv/dt is small, to generate a sufficient weak and very small discharge which is continuous. Further, with a region where the voltage of the acceleration pulse 33 acceleratedly increases, the acceleration pulse 33 can quickly rise up to a predetermined potential after the start of discharge. Therefore, the acceleration pulse 33 can produce the same effect as the above-discussed synthetic round pulse 11 produces.

Furthermore, with the acceleration pulse 33 or the acceleration pulse generation circuit 14*a*5, it is not necessary to switch over a plurality of round pulses by controlling ON/OFF of a plurality of switch elements, unlike with the above-discussed synthetic round pulse 11 and the like. In other words, only by controlling one switch element SW7, it is possible to generate the pulse to gently raise the voltage and then acceleratedly change it.

Though discussion has been made on the case where the acceleration pulse 33 rises from the ground potential (GND) in the present driving method as shown in FIG. 16, the acceleration pulse 33 may be superimposed on other pulse (the bias voltage as the simplest example).

Further, though the pulses 32 and 33 each have a positive polarity in the above discussion, the pulses 32 and 33 may each have a negative polarity.

<Variation>

In the above first to fifth preferred embodiments, discussion has been made on the case where the synthetic round pulse 11 or the like is applied to the electrode X, there may be a case where the synthetic round pulse generation circuit 14*a*3 or the like is provided in the driving device(s) 15 and/or 18 to apply the synthetic round pulse 11 or the like to the electrode(s) Y and/or W, respectively. Specifically, any one of the electrodes X, Y and W can correspond to the first electrode or the second electrode. For example, the synthetic round pulse 11 or the like can be thereby applied between the row electrodes X and Y or between the row electrode X or Y and the column electrode W. In this case, the electrode to which the synthetic round pulse 11 or the like is applied corresponds to the first electrode and the driver 14*a*, 15*a* or

18*a* thereof corresponds to the driving unit. Further, the synthetic round pulse 11 or the like may be applied to a plurality of electrodes.

Furthermore, the above discussion also applies to a case of a PDP having a structure in which the first and second electrodes are opposed to each other with the discharge space sandwiched therebetween (so-called a counter two-electrode type PDP).

While the invention has been shown and described in detail, the foregoing description is in all aspects illustrative and not restrictive. It is therefore understood that numerous modifications and variations can be devised without departing from the scope of the invention.

What is claimed is:

1. A plasma display device, comprising:

a plasma display panel comprising a discharge cell including a first electrode and a second electrode; and a driving unit for driving said discharge cell by giving a potential difference between said first electrode and said second electrode, wherein said driving unit generates a voltage pulse and outputs said voltage pulse as a voltage to be applied to said first electrode, said voltage pulse continuously changing from a first voltage to a second voltage and containing a portion at which a rate of voltage change increases in voltage range above a firing voltage with which discharge starts in said discharge cell.

2. The plasma display device according to claim 1, wherein said driving unit comprises a pulse generation unit capable of generating a voltage pulse by using a first pulse generation system and a second pulse generation system, and said voltage to be applied to said first electrode includes a first region which is generated by said first pulse generation system and contains said firing voltage and a second region which is generated by said second pulse generation system and occurs after said first region.

3. The plasma display device according to claim 1, wherein said pulse generation unit generates said voltage pulse by further using a third pulse generation system different from said first pulse generation system, and said driving unit generates said first region between said second region and a third region different from said first and second regions, said third region being generated by said third pulse generation system.

4. The plasma display device according to claim 1, wherein said voltage pulse includes part of one of a CR voltage pulse, a ramp voltage pulse, and an LC resonant voltage pulse.

5. The plasma display device according to claim 1, wherein said driving unit further comprises a power recovery unit, and said driving unit generates said voltage pulse by utilizing a reactive power recovered in said power recovery unit.

6. The plasma display device according to claim 1, further comprising:

a plasma display panel comprising a discharge cell including a first electrode and a second electrode; and a driving unit for driving said discharge cell by giving a potential difference between said first electrode and said second electrode, wherein said driving unit generates the voltage pulse, which continuously changes from the first voltage to the second voltage and changes more sharply as the voltage pulse approaches said second voltage, to output said voltage pulse as a voltage to be applied to said first electrode.

7. A driving device for a plasma display panel, said plasma display panel comprising a discharge cell including a first electrode and a second electrode, comprising:

a driving unit for driving said discharge cell by giving a potential difference between said first electrode and said second electrode, wherein said driving unit generates a voltage pulse and outputs said voltage pulse as a voltage to be applied to said first electrode, said voltage pulse continuously changing from a first voltage to a second voltage and containing a portion at which a rate of voltage change increases in voltage range above a firing voltage with which discharge starts in said discharge cell.

* * * * *